US009424804B2

(12) United States Patent
Jung et al.

(10) Patent No.: US 9,424,804 B2
(45) Date of Patent: Aug. 23, 2016

(54) METHOD AND APPARATUS FOR CONTROLLING SCREEN BRIGHTNESS CORRESPONDING TO VARIATION OF ILLUMINATION

(71) Applicant: Samsung Electronics Co., Ltd., Gyeonggi-do (KR)

(72) Inventors: Hansub Jung, Gyeonggi-do (KR); Kyoungmo Kim, Gyeonggi-do (KR); Wansang Park, Seoul (KR); Dongwook Kang, Seoul (KR); Seongji Jang, Busan (KR)

(73) Assignee: Samsung Electronics Co., Ltd (KR)

( * ) Notice: Subject to any disclaimer, the term of this patent is extended or adjusted under 35 U.S.C. 154(b) by 141 days.

(21) Appl. No.: 14/041,778

(22) Filed: Sep. 30, 2013

(65) Prior Publication Data

US 2014/0092119 A1 Apr. 3, 2014

(30) Foreign Application Priority Data

Sep. 28, 2012 (KR) ..... 10-2012-0109508

(51) Int. Cl.

| | |
|---|---|
| ***G09G 5/10*** | (2006.01) |
| ***G09G 3/20*** | (2006.01) |
| *G09G 3/34* | (2006.01) |

(52) U.S. Cl.

CPC *G09G 5/10* (2013.01); *G09G 3/20* (2013.01); *G09G 3/3406* (2013.01); *G09G 2320/0626* (2013.01); *G09G 2320/0653* (2013.01); *G09G 2360/144* (2013.01)

(58) Field of Classification Search

None

See application file for complete search history.

(56) References Cited

U.S. PATENT DOCUMENTS

| | | | | |
|---|---|---|---|---|
| 8,698,727 | B2 * | 4/2014 | Herz | G09G 3/3406 345/102 |
| 8,760,475 | B2 * | 6/2014 | Hsieh | G09G 3/20 345/102 |
| 2005/0134194 | A1 | 6/2005 | Murata | |
| 2006/0087245 | A1 * | 4/2006 | Ng et al. | 315/149 |
| 2007/0055955 | A1 * | 3/2007 | Lee | G09G 5/363 717/113 |
| 2011/0069096 | A1 | 3/2011 | Li et al. | |
| 2012/0019152 | A1 | 1/2012 | Barnhoefer et al. | |
| 2012/0019493 | A1 | 1/2012 | Barnhoefer et al. | |
| 2012/0068981 | A1 * | 3/2012 | Pantfoerder | G09G 3/20 345/207 |
| 2012/0075353 | A1 * | 3/2012 | Dong | H04N 5/58 345/690 |
| 2012/0162110 | A1 | 6/2012 | Kobayashi | |
| 2012/0169236 | A1 | 7/2012 | Kim | |
| 2012/0218282 | A1 * | 8/2012 | Choboter et al. | 345/589 |
| 2012/0242633 | A1 | 9/2012 | Kim et al. | |
| 2013/0147857 | A1 * | 6/2013 | Kurikko | G09G 3/20 345/690 |

FOREIGN PATENT DOCUMENTS

| | | |
|---|---|---|
| JP | 2006285063 | 10/2006 |
| JP | 2007163557 | 6/2007 |
| JP | 2011007939 | 1/2011 |
| KR | 20040033545 | 4/2004 |
| WO | WO 2006/072866 | 7/2006 |

* cited by examiner

*Primary Examiner* — Jwalant Amin

(74) *Attorney, Agent, or Firm* — The Farrell Law Firm, P.C.

(57) ABSTRACT

A method of controlling a screen brightness in a user device includes determining an illumination when a display unit is turned on, determining an optimal brightness according to the illumination and displaying according to the optimal brightness during an illumination change, determining an illumination when the current optimal brightness reaches a threshold, and determining an optimal brightness in the determined illumination and controlling a screen display according to the optimal brightness.

23 Claims, 15 Drawing Sheets

METHOD AND APPARATUS FOR CONTROLLING SCREEN BRIGHTNESS CORRESPONDING TO VARIATION OF ILLUMINATION

PRIORITY

This application claims priority under 35 U.S.C. §119(a) to a Korean patent application filed on Sep. 28, 2012 in the Korean Intellectual Property Office and assigned Serial No. 10-2012-0109508, the contents of which are incorporated herein by reference.

BACKGROUND OF THE INVENTION

1. Field of the Invention

The present invention generally relates to a method and apparatus for controlling screen brightness of a user device, and more particularly, to a method and apparatus for controlling screen brightness according to an illumination change capable of automatically controlling screen brightness based on an environment illumination.

2. Description of the Related Art

Various devices capable of communicating and processing personal information while moving, such as a mobile communication terminal, a such as a Personal Digital Assistant (PDA), an electronic organizer, a smartphone, and a tablet Personal Computer (PC) have been introduced during the recent advancement of digital technologies. Such user devices have been made to include various functions such as calling including voice and video, message transmission and reception including a Short Message Service (SMS)/Multimedia Message Service (MMS) and e-mail, navigation, photographing, broadcast replay, media (moving image and music) replay, Internet, messenger, and Social Network Service (SNS) functions.

Screen brightness in user devices is set according to a user's selection, and is maintained until the brightness is changed by user's operation. That is, the screen brightness of the display unit is constantly maintained regardless of the surrounding environment. Hence, when the user is in a dark environment, the screen is displayed well, but when goes to a bright environment, the screen may not be displayed well. In contrast, the screen is displayed well in a bright environment, but the screen becomes too bright in a dark environment, causing the user's eyes to become tired.

In order to solve this problem, an automatic brightness control function using an illumination sensor mounted on a user device has recently been provided. That is, the visibility of the screen displayed through the display unit changes according to the environment illumination and the screen brightness. For example, for the screen of the same brightness, the user may feel bright in a dark place, but dark in a bright place. Hence, the automatic brightness value setting of the screen in a user device applies screen brightness according to the illumination using the illumination sensor. The screen is controlled to be bright in a bright environment and to be dark in a dark environment using the illumination sensor.

However, the conventional art leads to the following inconveniences, which are not considered when automatically changing the screen brightness according to the environment illumination. That is, when the screen brightness is regulated, the illumination environment in which the screen brightness is to be changed is not considered. Hence, if the screen brightness is frequently changed whenever the illumination is changed, the user's screen concentration decreases, which decreases usability.

Further, an exceptional situation that the illumination sensor is covered by a user's body part, such as a hand or a face, or an object such as a noise-type illumination change, is not considered. That is, the screen brightness is changed when user covers the illumination sensor.

In addition, visually adapting to illumination when moving from a dark place to a bright place is different from visually adapting to darkness when moving from a bright place to a dark place. However, the conventional function of controlling screen brightness according to illumination does not consider characteristics of a user's angle of vision, such as light adaptation and dark adaptation.

SUMMARY OF THE INVENTION

The present invention has been made in view of the above problems, and an aspect of the present invention is to provide a method and apparatus for controlling screen brightness according to an illumination change capable of automatically controlling screen brightness according to an environment illumination.

Another aspect of the present invention is to provide a method and apparatus for controlling screen brightness according to an illumination change capable of providing appropriate screen brightness according to a surrounding illumination environment.

Another aspect of the present invention is to provide a method and apparatus for controlling screen brightness according to an illumination change capable of minimizing a brightness control error by a noise-type illumination change such as a situation when user covers an illumination sensor when controlling screen brightness using the illumination sensor.

Another aspect of the present invention is to provide a method and apparatus for controlling screen brightness according to an illumination change capable of providing optimal screen brightness in consideration of characteristics of user's angle of vision when controlling screen brightness according to illumination.

Another aspect of the present invention is to provide a method and apparatus for controlling screen brightness according to an illumination change capable of user convenience and usability of user device by implementing an optimal environment for supporting automatic control of screen brightness according to an illumination change.

In accordance with an aspect of the present invention, a method of controlling a screen brightness in a user device includes determining a first illumination when a display unit is turned on, determining an optimal brightness according to the first illumination with reference to predefined brightness profiles for respective illuminations, and controlling a screen display according to the optimal brightness, maintaining the optimal brightness when an illumination change is detected while a screen is displayed according to the optimal brightness, determining a second illumination when the current optimal brightness reaches a threshold of the brightness profile according to the illumination change; and determining an optimal brightness in the second illumination and controlling a screen display according to the optimal brightness.

In accordance with another aspect of the present invention, a method of controlling screen brightness in a user device includes determining an illumination when a screen is turned on, and determining a first optimal brightness according to the illumination, controlling a screen display according to the determined first optimal brightness, detecting an illumination change during the screen display, determining whether the illumination change corresponds to a noise-type illumination change, performing an exceptional process for the noise-type illumination change if the illumination change corresponds to the noise-type illumination change, determining whether an adaptation mode that considers characteristics of a user's vision angle is set after performing the exceptional process for the noise-type illumination change, or when the illumination change does not correspond to the noise-type illumination change, determining a second optimal brightness according to the illumination change based on the optimal brightness profile of the brightness profiles for respective illuminations if the adaptation mode has not been set, determining the adaptation optimal brightness according to the illumination change based on the adaptation optimal brightness profile of the brightness profiles for respective illuminations if the adaptation mode has been set, and controlling the screen display according to the determined second optimal brightness.

In accordance with another aspect of the present invention, a user device includes an illumination sensor configured to measure an illumination surrounding the user device, a display unit configured to display a screen corresponding to a screen brightness determined according to the surrounding illumination, a storage unit configured to store brightness profiles for respective illuminations, and a controller configured to control a screen display by determining an optimal brightness at a first illumination when the display unit is turned on with reference to the brightness profiles for respective illuminations, and to control a screen display by determining an optimal brightness at a second illumination when a current optimal brightness reaches a threshold of the brightness profiles for respective illuminations while maintaining the current optimal brightness when an illumination change is detected while the screen is displayed.

In accordance with another aspect of the present invention, there is provided a computer-readable recording medium having recorded thereon a method of controlling a screen brightness in a user device, the method including, determining a first illumination when a display unit is turned on, determining an optimal brightness according to the first illumination with reference to predefined brightness profiles for respective illuminations, and controlling a screen display according to the optimal brightness, maintaining the optimal brightness when an illumination change is detected while a screen is displayed according to the optimal brightness, determining a second illumination when the current optimal brightness reaches a threshold of the brightness profile according to the illumination change, and determining an optimal brightness in the second illumination and controlling a screen display according to the optimal brightness.

BRIEF DESCRIPTION OF THE DRAWINGS

The objects, features and advantages of the present invention will be more apparent from the following detailed description in conjunction with the accompanying drawings, in which.

DETAILED DESCRIPTION OF EMBODIMENTS OF THE INVENTION

Embodiments of the present invention are described with reference to the accompanying drawings in detail. The same reference numbers are used throughout the drawings to refer to the same or like parts. Detailed descriptions of well-known functions and structures incorporated herein are omitted for the sake of clarity and conciseness.

The present invention relates to a method and apparatus for controlling screen brightness according to an illumination change. According to an embodiment of the present invention, an illumination change of a surrounding environment is sensed using an illumination sensor, and screen brightness is automatically controlled as an optimal brightness value according to a changed illumination. In particular, according to an embodiment of the present invention, screen brightness is controlled in consideration of such instances as a changed illumination environment, a noise-type illumination change, and characteristics of user's angle of vision. As such, when screen brightness is controlled according to an illumination change, the visibility (or readability) of the user device is improved, and the user's desire to control of screen brightness is satisfied.

The configuration of the user device and the method of controlling operation thereof according to an embodiment of the present invention are not limited by the description below, and are applied to various embodiments based on the embodiments described below.

Figure 1:
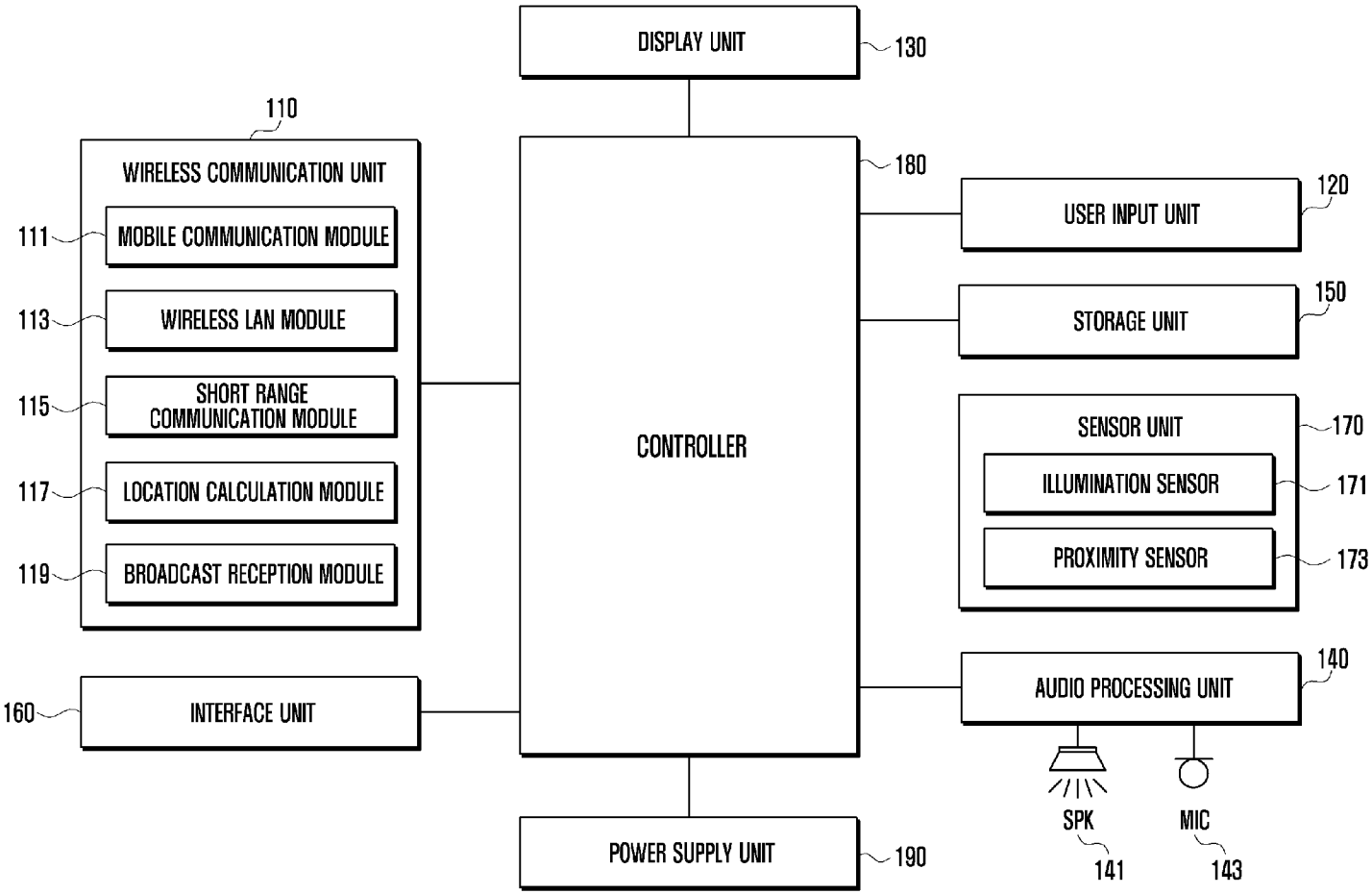
FIG. 1 illustrates a configuration of a user device according to an embodiment of the present invention.

FIG. 1 illustrates a configuration of a user device according to an embodiment of the present invention.

Referring to FIG. 1, a user device of the present invention includes a wireless communication unit 110, a user input unit 120, a display unit 130, an audio processing unit 140, a storage unit 150, an interface unit 160, a sensor unit 170, a controller 180, and a power supply unit 190. Some components of the user device described in FIG. 1 are not essential, and thus are optionally included in the user device. For example, when the user device according to an embodiment of the present invention does not support a separate communication function, the configuration of the wireless communication unit 110 is omitted.

The wireless communication unit 110 includes one or more modules that allow wireless communication between the user device and a wireless communication system or between the user device and a network where another user device is located. For example, the wireless communication unit 110 includes a mobile communication module, a Wireless Local Area Network (WLAN) module 113, a short-range communication module 115, a location calculation module 117, and a broadcast reception module 119.

The mobile communication module 111 transmits wireless signals to and receives wireless signals from at least one of a base station, an external terminal, and a server. The wireless signals include a voice call signal, a video call signal, or various forms of data according to text/multimedia message transmission/reception. The mobile communication module 111 may download a mapping table where the brightness profile for each illumination is mapped for controlling screen brightness for each illumination, by connecting to a company server or a contents server according to control of the controller 180.

The wireless LAN module 113 is for connecting to wireless Internet and forming a wireless LAN link with another user device, and is internally or externally mounted in the user device. Some examples of usable wireless Internet technologies are Wi-Fi, Wireless broadband (Wibro), World interoperability for microwave access (Wimax), and High-Speed Downlink Packet Access (HSDPA). The wireless LAN module 113 connects to a company server or a contents server according to control of the controller 180, and a mapping table is downloaded where the brightness profile is mapped with illumination for controlling screen brightness for each illumination. When the wireless LAN link is formed with another user device, the wireless LAN module 113 transmits to or receives from another user device, the mapping table for controlling the screen brightness for each illumination according to a user's selection. The wireless LAN module 113 may download the mapping table for controlling the screen brightness for each illumination through wireless LAN. The mapping table is transmitted to or received from a cloud server.

The short-range communication module 115 is for short-range communication. Some examples of short-range communication technologies are Bluetooth®, Radio Frequency IDentification (RFID), Infrared Data Association (IrDA), Ultra WideBand (UWB), ZigBee® and Near Field Communication (NFC). When short-range communication module 115 is connected with another user device, the module 115 transmits to or receives from another user device, the mapping table for control of screen brightness for each illumination according to a user's selection.

The location calculation module 117 is for obtaining a location of the user device, and a representative example of the user device is a Global Positioning System (GPS). The location calculation module 117 may calculate distance information from three or more base stations and time information, and calculate three-dimensional current location information according to latitude, longitude, and altitude by applying trigonometry to the calculated information. The location calculation module 117 may calculate location information by continually receiving the current location of the user device from three or more satellites in real time. The location information of the user device is obtained in various methods.

The broadcast reception module 119 receives a broadcast signal (e.g., a TeleVision (TV) broadcast signal, a radio broadcast signal, and a data broadcast signal) and/or the broadcast-related information (e.g., information related to a broadcast channel, a broadcast program or a broadcast service provider) from an external broadcast management server through a broadcast channel (e.g., a satellite channel, or a ground wave channel).

The user input unit 120 generates input data for the user to control operation of the user device. The user input unit 120 is composed of such components as a key pad, a dome switch, a touch pad (constant voltage/constant current), a jog wheel, and a jog switch. The user input unit 120 is implemented in a button form at the outside of the user device, and some buttons is implemented as a touch panel.

The display unit 130 displays (outputs) information processed in the user device. For example, when the user device is at a calling mode, a screen interface such as a user interface (UI) or graphic UI (GUI) related to calling is displayed. When the user device is at a video call mode or a photographing mode, the display unit 130 displays a photographed or/and received image, UI, or GUI. In particular, the display unit 130 displays a screen according to the screen brightness value determined according to control of the controller 180. The display unit 130 displays various UIs and GUIs related to forming a mapping table for controlling screen brightness.

The display unit 130 includes at least one of a Liquid Crystal Display (LCD), a Thin Film Transistor (TFT) LCD, a Light Emitting Diode (LED), an Organic LED (OLED), an Active Matrix OLED (AMOLED), a flexible display, a bended display, and a 3-Dimensional (3D) display. Some of the displays are implemented as a transparent display formed as a transparent type or an optical transparent type so that an external side is visible.

When the display unit 130 is a touch panel that senses a touch operation from a layer structure (hereinafter, "touch screen"), the display unit 130 is used as an input device as well as an output device. The touch panel is configured to convert a change of pressure applied to a certain part of the display unit 130, or capacitance generated in a certain part of the display unit 130, into an electric input signal. The touch panel is configured to detect touch pressure as well as the touched location and area. When there is a touch input for the touch panel, the corresponding signals are sent to the touch controller (not shown). The touch controller (not shown) processes the signals and transmits corresponding data to the controller 180. As such, the controller 180 may recognize which part of the display unit 130 has been touched.

The audio processing unit 140 transmits audio signals received from the controller 180 to the SPeaKer (SPK) 141, and transmits audio signals such as a voice inputted from the MICrophone (MIC) 143 to the controller 180. The audio processing unit 140 converts voice/sound data into audible sounds, outputs the audible sounds through the SPK 141 according to control of the controller 180, and converts audio signals such as sounds received from the MIC 143 into digital signals to be transmitted to the controller 180.

The SPK 141 outputs audio data received from the wireless communication unit 110 or stored in the storage unit 150 at a calling mode, a recording mode, a broadcast reception mode, or a photographing mode, for example. The SPK 141 outputs sound signals related to a function performed in the user device, such as a screen brightness change, call connection reception, call connection transmission, photographing, and music file replay).

The MIC 143 receives external sound signals at the calling mode, recording mode, voice-recognition mode, or photographing mode, and processes the received sound signals as electric sound data. In the calling mode, the processed voice data is converted into a transmittable form and is outputted to the mobile communication base station through the mobile communication module 111. Various noise—removing algorithms for removing noises generated in the process of receiving external sound signals are implemented in the MIC 143.

The storage unit 150 stores a program for processing and controlling the controller 180, or temporarily stores inputted/outputted data, such as a mapping table, phone number, message, audio data, video data, and e-book. The storage unit 150 stores a use frequency according to operation of a user device function, including but not limited to a screen brightness use frequency, an application use frequency, a phone number, a message, a multimedia use frequency, importance, and priority. The storage unit 150 also stores data on vibrations and sounds of various patterns outputted at the time of a touch input on a touch screen.

In particular, the storage unit 150 stores a mapping table where screen brightness profiles are mapped with illuminations for controlling screen brightness for each illumination. The brightness profile for each illumination includes the profile corresponding to minimum brightness, optimal brightness, maximum brightness, dark adaptation optimal brightness, and light adaptation optimal brightness. In the following description, the minimum brightness refers to the minimum brightness at which visibility is rendered to the user, the optimal brightness refers to the optimal brightness at which the best visibility is rendered to the user, the maximum brightness refers to the maximum brightness at which visibility is rendered to user, the dark adaptation optimal brightness refers to the optimal screen brightness in the dark adaptation situation, and the light adaptation optimal brightness refers to the optimal screen brightness in the light adaptation situation.

The storage unit 150 includes at least one of storage media among a memory type such as a flash memory, a hard disk, a micro, a card such as an SD card or XD card, and a memory such as a Random Access Memory (RAM), a static RAM (SRAM), a Read-Only Memory (ROM), a Programmable ROM (PROM), an Electrically Erasable PROM (EEPROM), a Magnetic RAM (MRAM), a magnetic disk, and an optical disk. The user device is related to a web storage that performs the storage function of the storage unit 150 in Internet to be operated.

The interface unit 160 serves as a path to all external devices connected to the user device. The interface unit 160 receives data transmitted from an external device, receives and transmits the power to each internal component of the user device, or transmits internal data of the user device to an external device. For example, a wired/wireless headset port, an external charger port, a wired/wireless data port, a memory card port, a port for connecting a device including an identification module, an audio input/output port, a video input/output port, and an earphone port are included in the interface unit 160.

The sensor unit 170 includes one or more modules that sense a state change of the user device. For example, the sensor unit 170 includes an illumination sensor 171 and a proximity sensor 173.

The illumination sensor 171 measures illumination, i.e., an amount of light around the user device, periodically or according to control of the controller 180. The illumination sensor 171 is implemented using Cadmium Sulfide (CdS) photoconductive cells, which are operated in a manner that internal resistance is changed according to the amount of light. When there is no light, the CdS photoconductive cells get close to an insulator and cannot flow electric current, but when there is light, the internal resistance of CdS photoconductive cells decreases so that current can freely flow. The CdS photoconductive cells are an example of an illumination sensor 171, and all sensors capable of measuring the amount of light may be used as the illumination sensor 171. A detailed configuration and operation scheme of the illumination sensor 171 is a well-known technology, and is thus omitted here.

The proximity sensor 173 determines whether there is an object approaching or existing near the user device. The proximity sensor 173 senses an object within a preset distance from the user device periodically or according to control of the controller 180. Generally, the proximity sensor 173 is a switch that detects whether there is an object approaching or existing around a detection surface (e.g., the surface of the display unit 130) without a mechanical contact using the force of an electromagnetic field. Some examples of types of the proximity sensor 173 are a magnetic, a magnetic saturation, a high frequency oscillation, a differential coil, and a capacitance type. The operation scheme and configuration of the proximity sensor of each type is a well-known technology, and is thus omitted here.

The controller 180 controls overall operation of the user device. For example, the controller 180 performs control related to a voice call, data communication and a video call. In particular, the controller 180 controls overall operation related to the automatic adjustment of the screen brightness according to the illumination change in an embodiment of the present invention. The controller 180 includes a multimedia module (not shown) for a multimedia replay. In the present invention, the multimedia module (not shown) is implemented within the controller 180 or separately from the controller 180.

According to an embodiment of the present invention, the controller 180 controls a screen brightness change according to illumination using the screen brightness value when the screen is turned on, when the illumination is increased, and when the illumination is decreased. The controller 180 controls exceptional situations such us when the illumination sensor 171 is covered or a noise-type illumination change such as errors of the illumination sensor 171 generated by the angle with the light source. The controller 180 controls a screen brightness change that considers visual characteristics of the user as in the screen brightness at the time of either dark adaptation or light adaptation.

According to an embodiment of the present invention, the controller 180 controls the screen display by determining the optimal brightness in the illumination when the display unit 130 is turned on by referring to the predefined brightness profile for each illumination in the storage unit 150. When the illumination change is detected by the illumination sensor 171 during the screen display, the controller 180 controls the screen display by determining the optimal brightness at the illumination sensor 171 when the current optimal brightness reaches the threshold value of the brightness profile for each illumination.

When the illumination change is detected, the controller 180 analyzes whether the illumination change corresponds to the noise-type illumination change, and exceptionally processes the noise-type illumination change by maintaining the current screen brightness for the noise-type illumination change. For example, the controller 180, when the noise-type illumination changes, omits processes for controlling of screen brightness in associated with the noise-type illumination change. If the current optimal brightness reaches the threshold of the brightness profile for each illumination according to the illumination change while the current screen brightness is maintained, the controller 180 controls the screen brightness change of the display unit 130 by determining the optimal brightness in the illumination at the reached time point.

When the adaptation mode is at a non-set state according to an embodiment of the present invention, the controller 180 determines the optimal brightness according to the illumination change based on the optimal brightness profile of the brightness profile for each illumination. When in the adaptation mode setting state, the controller 180 determines the optimal adaptation profile according to the illumination change based on the optimal adaptation brightness profile of the brightness profile for each illumination when in the adaptation mode setting state.

In the light adaptation, the controller 180 more quickly reflects the illumination value measured by the illumination sensor 171 on the screen compared to the dark adaptation, and more slowly reflects the illumination value measured by the illumination sensor 171 on the screen compared to the dark adaptation so that sufficient dark adaptation time is secured.

The detailed control operation of the controller 180 will be described in the operation example of the user device and the method of controlling the same with reference to the drawings.

The power supply unit 190 receives external power and internal power and supplies power needed for the operation of each component by control of the controller 180.

Various embodiments described in the present invention are implementable within a recording medium readable by a computer or a similar device using software, hardware or a combination thereof. In the hardware implementation, the embodiments described in the present invention are implemented using at least one of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, and electric units for performing other functions.

In some cases, the embodiments described in the present specification are implemented by the controller 180 itself. In the software implementation, the embodiments such as procedures and functions described in the present specification are implemented as separate software modules. Each of the software modules performs one or more functions and operations described in the present specification.

The recoding medium includes a computer-readable recording medium having recorded thereon a program which processes a screen display by determining the optimal brightness in the illumination when the display unit is turned on with reference to the predefined brightness profile for each illumination, and processes the screen display by determining the optimal brightness in the illumination when the current optimal brightness reaches the threshold of the brightness profile for each illumination while maintaining the current optimal brightness when the illumination change is detected during the screen display.

The user device of FIG. 1 of the present invention includes all devices that use an Application Processor (AP), a Graphic Processing Unit (GPU), and a Central Processing Unit (CPU), such as all information communication devices, multimedia devices and their application devices. For example, the user device includes a tablet Personal Computer (PC), a smart phone, a digital camera, a Portable Multimedia Player (PMP), a media player, a portable game console, and a personal digital assistant as well as mobile communication terminals operated according to respective communication protocols corresponding to various communication systems. The method of controlling the function of the present invention is applied to various display devices such as a digital television, a digital signage and a Large Format Display (LFD).

Figure 2:
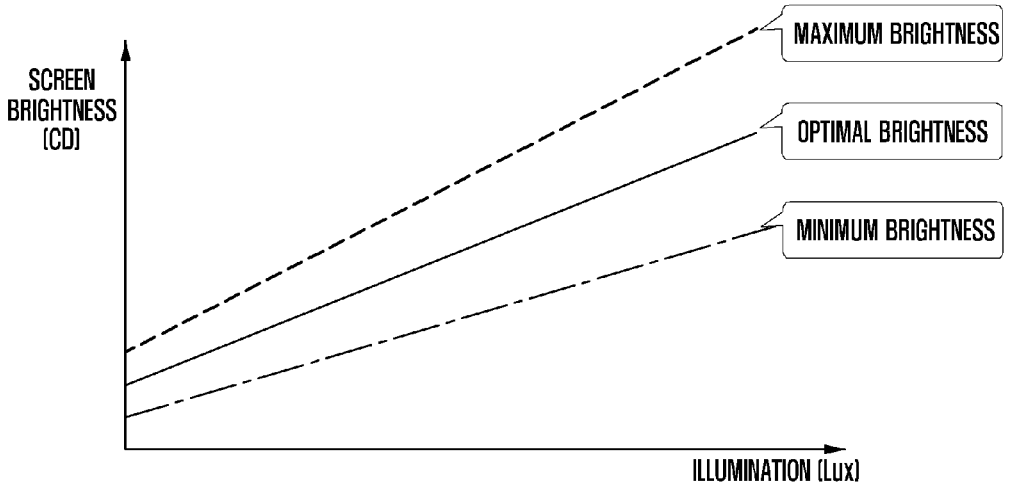
FIG. 2 illustrates a brightness profile according to illumination defined in a user according to an embodiment of the present invention.

FIG. 2 illustrates a brightness profile according to illumination defined in a user according to an embodiment of the present invention.

Referring to FIG. 2, three brightness profiles for respective illuminations are configured to define the range of the screen brightness according to illumination.

Generally, if a pencil of light (Lm) is projected to a certain object by a certain light source, such as the Sun, the Moon, a fluorescent lamp, an incandescent lamp, and a mercury lamp, the surface becomes bright, and the illumination indicates the brightness level. The unit of the illumination is Lux (or Fc) (1 Fc=10.76 Lux). If the pencil of light F(Lm) is equally projected on the surface of the unit area A(m2), the illumination of the surface is E Lux=F(Lm)/A(m2). That is, the illumination when the pencil of light projected to the surface of 1(m2) is 1(Lm) is 1 Lux(Lx). The unit of the screen brightness includes CD (candle) or candela.

As illustrated in FIG. 2, the horizontal axis of FIG. 2 indicates the illumination, and the vertical axis indicates the screen brightness. In an embodiment of the present invention, three brightness profiles for illuminations are defined to define the screen brightness range according to illumination. The brightness profiles for respective illuminations are divided into a minimum brightness, an optimal brightness, and a maximum brightness. The minimum brightness is the minimum brightness at which the visibility is rendered to user, the optimal brightness is the optimal screen brightness at which the best visibility is rendered to user, and the maximum brightness is the maximum screen brightness at which the visibility is rendered to user.

In the present invention, the optimal screen brightness when the screen is turned on based on the brightness profiles for respective illuminations defined as in FIG. 2 is controlled, and the optimal screen brightness when the illumination is changed (e.g., illumination increase or illumination decrease) when the screen is turned on is controlled.

Figure 3:
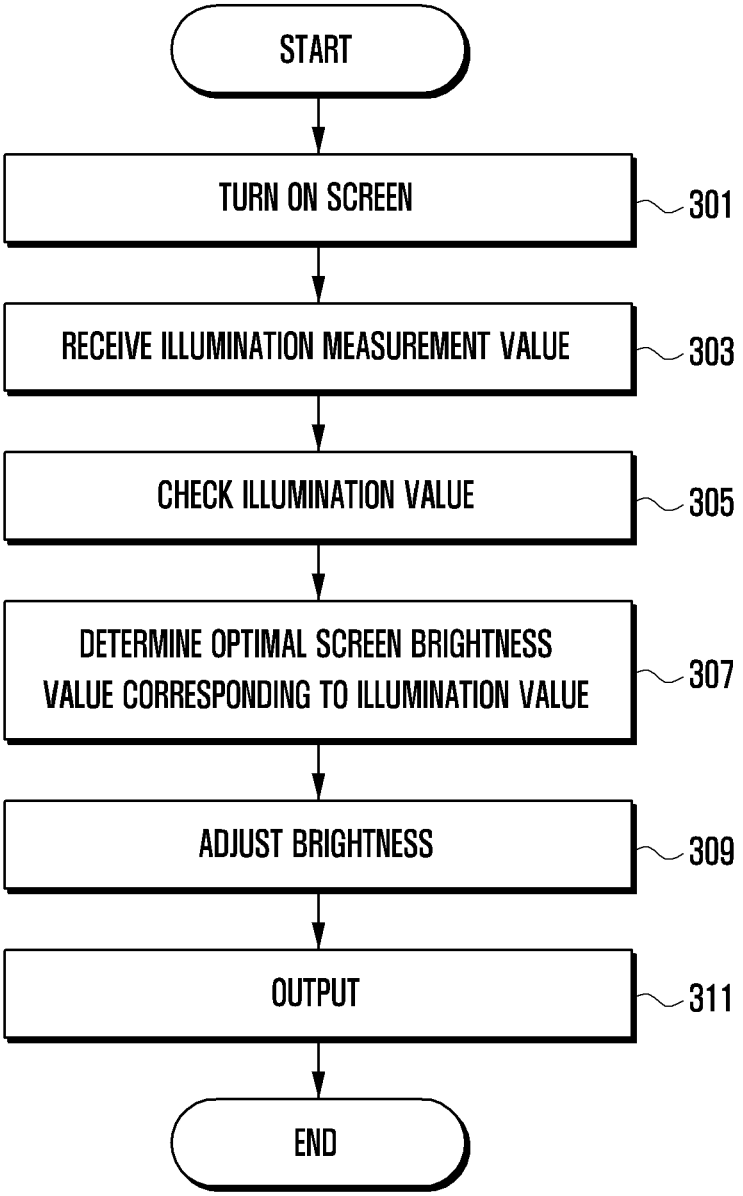
FIGS. 3 and 4 illustrate an operation of controlling screen brightness when a screen is turned on in a user device according to an embodiment of the present invention.
Figure 4:
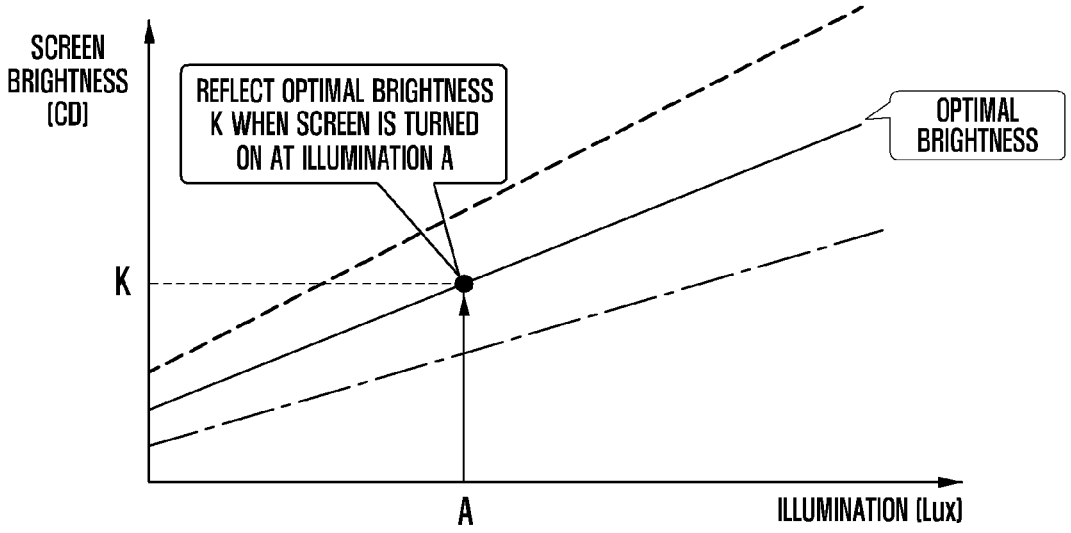

FIGS. 3 and 4 illustrate an operation of controlling screen brightness when a screen is turned on in a user device according to an embodiment of the present invention.

In particular, FIGS. 3 and 4 illustrate an operation of controlling screen brightness when the screen of the display unit 130 is turned on in an embodiment of the present invention.

Referring to FIG. 3, when the power is supplied to the display unit 130 and the screen is turned on in step 301, the controller 180 receives the illumination value measured from the illumination sensor 171 in step 303 and confirms the illumination value at that point in step 305. For example, in a standby state, when an event such as a user's input or a reception of a call request occurs while power of the display unit 130 is blocked, the controller 180 supplies power to the display unit 130 so that the display unit 130 displays information. The controller 180 determines the illumination value at the turned-on time point of the screen by receiving the illumination measurement value from the illumination sensor 171 when power is supplied to the display unit 130 and the screen is turned on. The illumination sensor 171 measures illumination periodically or according to control of the controller 180 (particularly, control at the turned-on time point of the screen), and transmit the measured value to the controller 180. At this time, the controller 180 controls the measurement of the illumination environment change according to the change-sensing sensitivity (e.g., sensitive, normal, and slow), which defines the criterion state of sensing the illumination change.

The controller 180 determines the screen brightness value corresponding to the optimal brightness profile based on the illumination value in step 307. That is, the controller 180 traces the screen brightness value mapped with the illumination value in the predefined optimal brightness profile and determines the traced screen brightness value as the optimal screen brightness value for the illumination value as described with reference to FIG. 2.

The controller 180 regulates the screen brightness for the determined optimal screen brightness value in step 309, and controls the screen output according to the adjusted screen brightness in step 311. That is, the controller 180 sets the screen brightness of the display unit 130 to the brightness corresponding to the measured illumination. For example, if the surrounding illumination measured by the illumination sensor 171 is A (Lux) and the screen brightness value of the optimal brightness profile mapped with the illumination A (Lux) is K (cd), the controller 180 sets the brightness of the display unit 130 to K (cd). Such an example of operation is displayed in FIG. 4.

As illustrated in FIG. 4, it is assumed that the illumination value when the power is supplied to the display unit 130 and the screen is turned on is A (Lux), and the brightness value corresponding to the optimal brightness profile based on the illumination value A is K (cd).

Hence, the controller 180 searches for the optimal brightness of the display unit 130 corresponding to the illumination measured when the power is supplied to the display unit 130 and the screen is turned on, from the mapping table. The controller 180 extracts the optimal screen brightness mapped at the measured illumination and applies (or sets or adjusts) the extracted optimal screen brightness value K to the screen brightness of the display unit 130.

Figure 5:
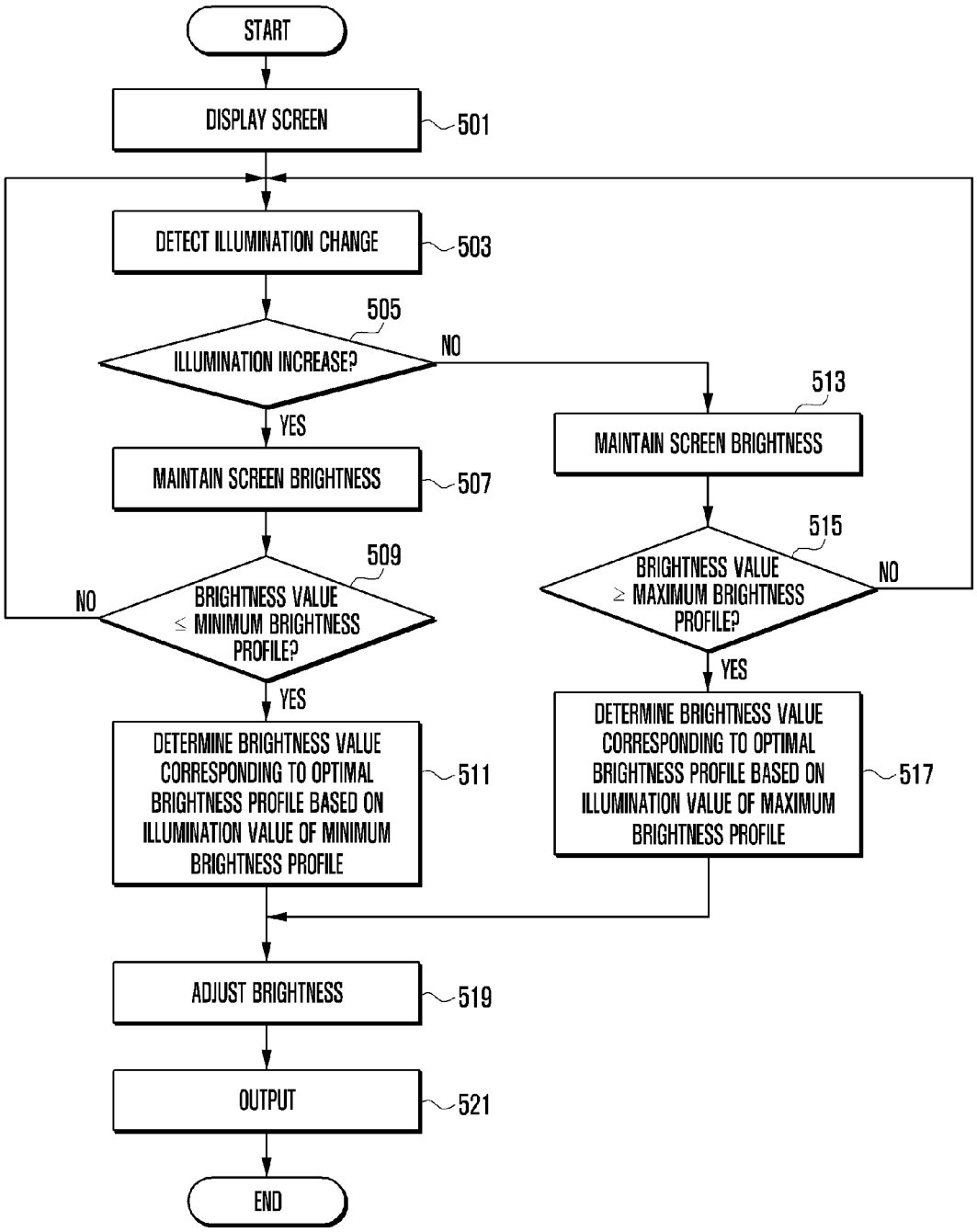
FIGS. 5 to 7 illustrate an operation of controlling screen brightness according to an illumination change while a screen is displayed in a user device according to an embodiment of the present invention.
Figure 6:
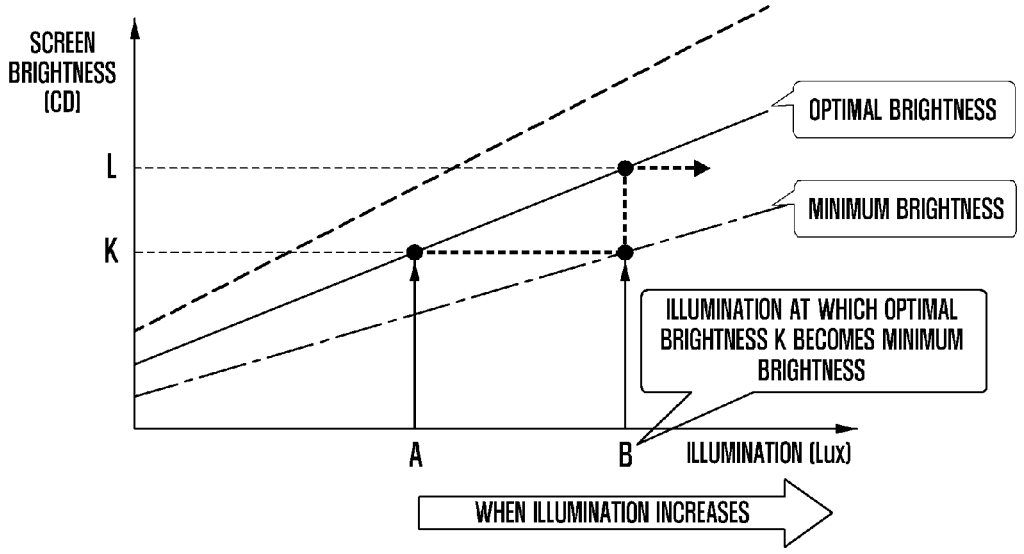
Figure 7:
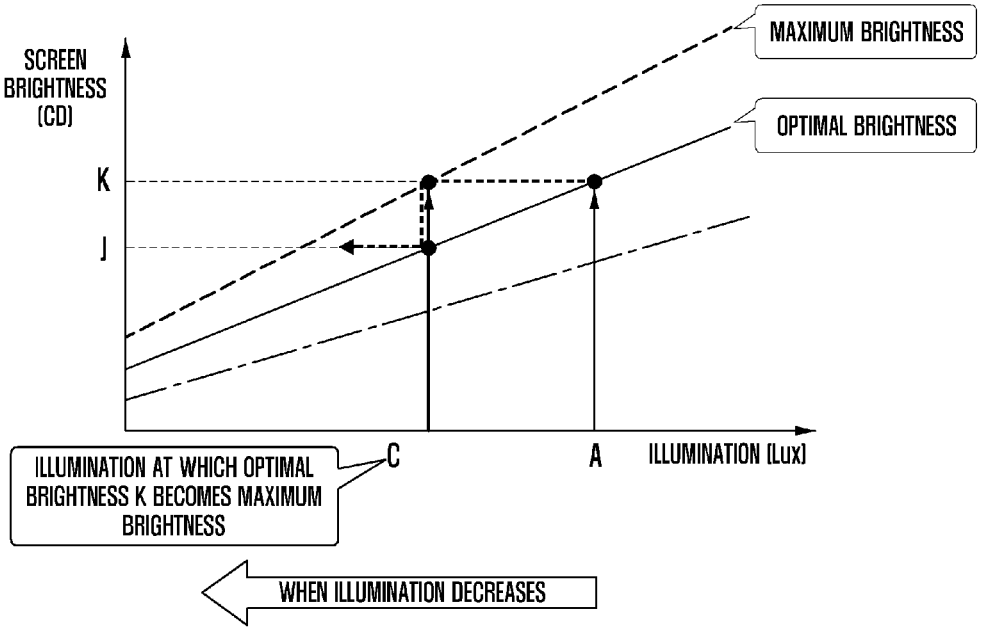

FIGS. 5 to 7 illustrate an operation of controlling screen brightness in a user device according to an embodiment of the present invention.

In particular, FIGS. 5 to 7 illustrate an operation of controlling screen brightness according to an illumination change, such as an illumination increase and an illumination decrease, while a screen is displayed by a certain screen brightness value according to an embodiment of the present invention.

Referring to FIG. 5, the controller 180 detects an illumination value change by the measured illumination value received from the illumination sensor 171 in step 503 while the screen is displayed as the optimal screen brightness value for the current illumination in step 501. For example, the illumination sensor 171 measures the illumination periodically or according to control of the controller 180, and transmits the measured value to the controller 180. Then the controller 180 determines the change of the previous value and the current value by monitoring the measured illumination value received from the illumination sensor 171, and determines the change by comparing the illumination corresponding to the current screen brightness of the display unit 130 with the measured illumination. The controller 180 controls the measurement of the illumination screen change according to the change sensing sensitivity (e.g., sensitive, normal, and slow) that defines the criterion state for sensing the illumination change.

When detecting the illumination value change, the controller 180 determines whether the illumination change value corresponds to the illumination value increase or the illumination value decrease in step 505.

If the illumination value increase is determined (YES of step 505), the controller 180 maintains the current screen brightness value in step 507 and determines the time point when the screen brightness value becomes less than or equal to the minimum brightness profile in step 509.

If the screen brightness value does not become less than or equal to the minimum brightness profile (NO of step 509), the controller 180 continually monitors the illumination value change while maintaining the current screen brightness value. Frequent screen brightness changes according to the illumination change are restricted according to an embodiment of the present invention, and thus user convenience is enhanced.

If the screen brightness value becomes less than or equal to the minimum brightness profile (YES of step 509), the controller 180 determines the screen brightness value corresponding to the optimal brightness profile based on the illumination value when the screen brightness value becomes less than or equal to the minimum brightness profile in step 511. That is, as illustrated in FIG. 2, the controller 180 refers to the predefined brightness profile for each illumination, extracts the screen brightness value mapped with the optimal brightness profile in the illumination value when the screen brightness value becomes less than or equal to the minimum brightness profile, and determines the extracted screen brightness value as the optimal screen brightness value for the illumination value.

If the illumination value decrease is determined (No of step 505), the controller 180 maintains the current screen brightness value in step 513 and determines the time point when the screen brightness value is greater than or equal to the maximum brightness profile in step 515.

If the screen brightness value does not become greater than or equal to the maximum brightness profile (No of step 515), the controller 180 maintains the current screen brightness value and continually monitors the illumination value change. The frequent screen brightness change according to the illumination change is restricted, and thus user convenience is enhanced.

If the screen brightness value becomes greater than or equal to the maximum brightness profile (Yes of step 515), the controller 180 determines the screen brightness value corresponding to the optimal brightness profile based on the illumination value when the screen brightness value becomes greater than or equal to the maximum brightness profile in step 517. That is, as illustrated in FIG. 2, the controller 180 refers to the predefined brightness profile for each illumination, extracts the screen brightness value mapped with the optimal brightness profile in the illumination value when the brightness profile becomes greater than the optimal brightness profile, and determines the extracted screen brightness value as the optimal screen brightness value for the illumination value.

In step 519 the controller 180 regulates the screen brightness for the optimal screen brightness value determined in step 511 or 517, and controls the screen output according to the regulated screen brightness in step 521. That is, the controller 180 sets the screen brightness of the display unit 130 as the optimal screen brightness corresponding to the current illumination.

FIG. 6 illustrates an example of determining the screen brightness when illumination increases, and FIG. 7 illustrates an example of determining the screen brightness when the illumination decreases.

FIG. 6 assumes the current illumination value is A and the optimal screen brightness value mapped with the illumination A is K. Further, it is assumed that the illumination value at which the optimal screen brightness value K becomes less than or equal to the minimum brightness profile is B, and the screen brightness value mapped with the illumination B is L.

Referring to FIG. 6, when the illumination increases, the controller 180 maintains the same brightness value K, and applies the screen brightness value L corresponding to the optimal brightness profile to the screen brightness of the display unit 130 in the illumination B where the brightness value becomes less than or equal to the minimum brightness profile. That is, the controller 180 searches for the optimal brightness corresponding to the illumination (illumination at the minimum brightness) when the screen brightness value becomes less than or equal to the minimum brightness profile. The controller 180 extracts the optimal screen brightness mapped in the illumination of the minimum brightness, and applies the extracted optimal screen brightness value L to the screen brightness of the display unit 130.

As illustrated in FIG. 7, it is assumed that the current illumination value is A and the optimal screen brightness value mapped with the illumination A is K. The illumination value at which the screen brightness value K becomes greater than the maximum brightness profile is C, and the screen brightness value of the optimal brightness profile mapped with the illumination C is J.

Referring to FIG. 7, when the illumination decreases, the controller 180 maintains the same brightness value K and applies the screen brightness value J corresponding to the optimal brightness profile to the screen brightness of the display unit 130 at the illumination C where the brightness value becomes greater than the maximum brightness profile. That is, the controller 180 searches for the optimal brightness corresponding to the illumination (illumination of the maximum brightness) when the screen brightness value becomes greater than the maximum brightness profile. The controller 180 extracts the optimal screen brightness mapped in the illumination of the maximum brightness, and applies the extracted optimal screen brightness value J to the screen brightness of the display unit 130.

Figure 8:
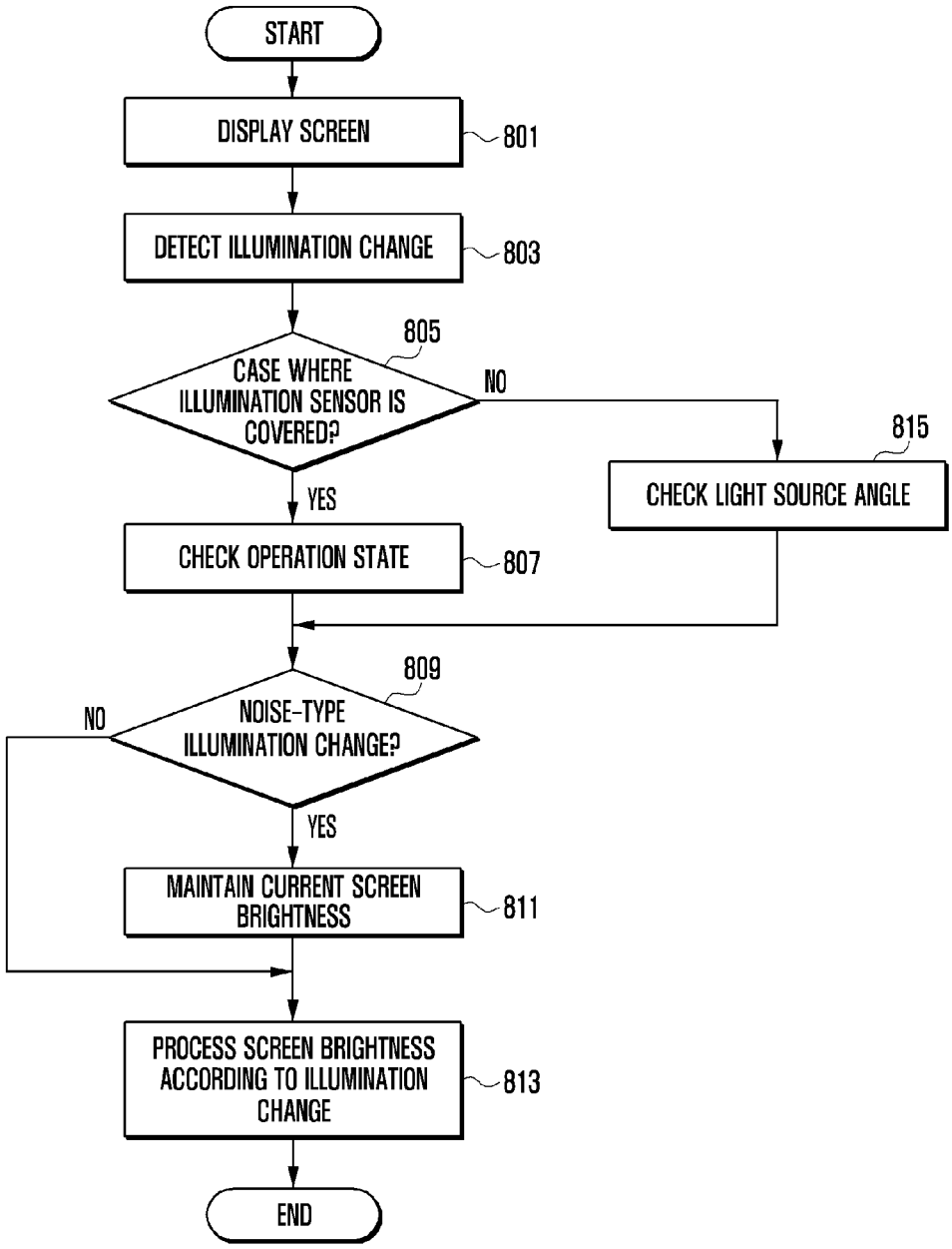
FIGS. 8 and 9 illustrate a process for a noise-type illumination change in a user device according to an embodiment of the present invention.
Figure 9:
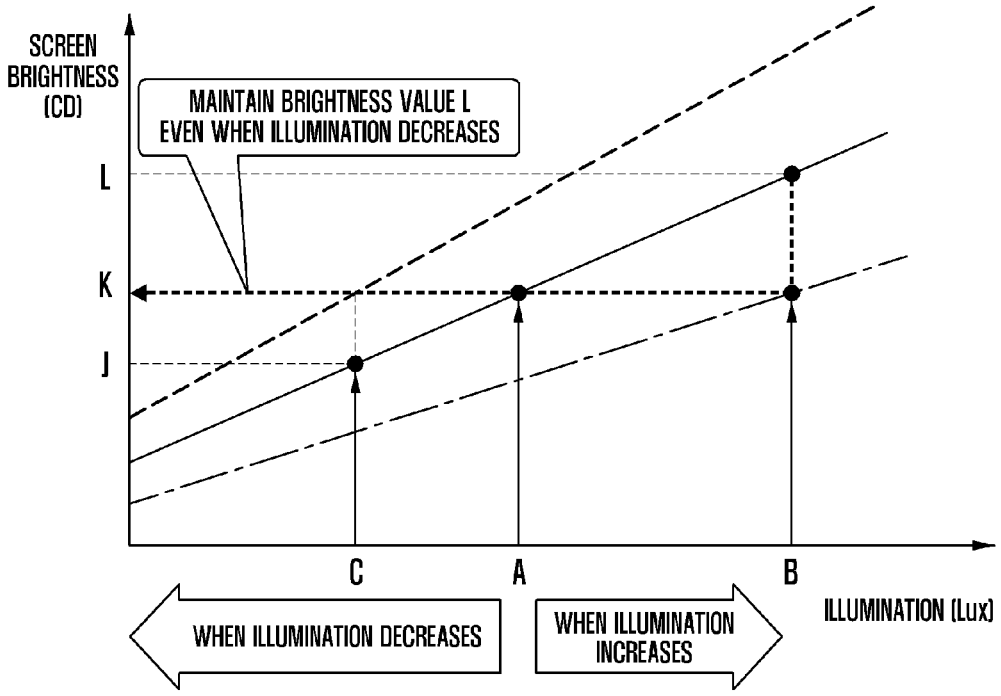

FIGS. 8 and 9 illustrate a screen brightness control operation in a user device according to an embodiment of the present invention.

In particular, FIGS. 8 and 9 illustrate an operation of determining the noise-type illumination change and performing an exceptional process for the noise-type illumination change. The noise-type illumination change in an embodiment of the present invention includes an illumination change that occurs as the illumination sensor 171 is covered when user uses a user device, and an illumination change that occurs according to the angle change between the user device and the light source, such as the Sun, the Moon, a fluorescent lamp, an incandescent lamp, and a mercury lamp.

The change sensing sensitivity for the illumination change is predefined, and when an exceptional process for the noise-type illumination change is processed, the exceptional process is performed according to the predefined change sensing sensitivity. For example, in the present invention, the change sensing sensitivity is distinguished by selection options such as "sensitively sensing the user's illumination environment", "normally sensing the user's illumination environment", and "slowly sensing the user's illumination environment". The user sets the change sensing sensitivity to one optional selection among the above options through the option setting menu (user interface) related to the screen brightness control, and provides the illumination environment information (e.g., sensitively sensing the user's illumination environment) which is set by user.

Referring to FIG. 8, the controller detects the illumination value change by the illumination measurement value received from the illumination sensor 171 while displaying the screen as the optimal screen brightness value in step 801 on the current illumination in step 803. For example, the illumination sensor 171 measures the illumination periodically or according to control of the controller 180 and transmits the measured value to the controller 180. Then the controller 180 determines the change of the previous value and the current value by monitoring the illumination measurement value received from the illumination sensor 171. The controller 180 controls the illumination environment change according to the predefined change sensing sensitivity (e.g., sensitively, normally and slowly).

According to an embodiment of the present invention, the controller 180 determines whether the illumination value change corresponds to the noise-type illumination change when detecting the illumination value change. For example, in the present invention, the controller 180 determines whether the illumination value change is a rapid change (i.e., a rapidly decreasing change) by a phenomenon that the illumination sensor 171 is covered, or is a change according to the angular change between the illumination sensor 171 and the light source. That is, according to an embodiment of the present invention, the noise-type illumination change is distinguished and an exceptional process for the screen brightness is performed for the noise-type illumination change.

The controller 180 determines whether the illumination change corresponds to when the illumination sensor 171 is covered in step 805.

If it is determined that the illumination sensor 171 is covered (Yes of step 805), the controller 180 determines the operation state of the user device in step 807. For example, the controller 180 determines conditions such as whether an object (e.g., a user's hand or face.) is sensed from the proximity sensor 173, a user event such as a touch occurs through the display unit 130 (particularly, a touch screen), the voice call function is being performed, or the illumination sensor 171 is positioned beside or under the user device on the basis of the screen of the display unit 130 (i.e., a position where the illumination sensor 171 is covered by a hand when the user device is raised).

The controller 180 determines whether the illumination change is a noise-type illumination change according to the operation state of the user device in step 809. For example, the controller 180 determines whether the operation state of the user device corresponds to at least one of the above conditions.

If the illumination change corresponds to any one of the conditions (Yes of step 809), that is, if it is determined that the change is a noise-type illumination change, the controller 180 maintains the current screen brightness value in step 811. The controller 180 maintains the basic screen brightness value even if the illumination (e.g., an illumination decrease) changes by the covering of the illumination sensor 171. That is, it is determined that the phenomenon is an intended covering phenomenon of the illumination sensor 171, an exceptionally processing of the screen brightness control for the phenomenon occurs. For example, the controller 180 omits processes for controlling of screen brightness in associated with the noise-type illumination change. Thereafter, the controller 180 processes the above described screen brightness control routine according to the illumination change in step 813, which is illustrated in FIG. 9.

As illustrated in FIG. 9, as the illumination sensor 171 is covered, the existing screen brightness K is maintained even if the illumination decreases. Thereafter, as the covering of the illumination sensor 171 by a certain object is cancelled, if the illumination increases, the controller 180 maintains the same brightness value K as the existing screen brightness K, determines the optimal screen brightness L corresponding to the optimal brightness profile at the illumination B where the screen brightness value becomes less than or equal to the minimum brightness profile, and sets the screen brightness by the determined optimal screen brightness value L.

If the illumination change does not correspond to when the illumination sensor 171 is covered (No of step 805), the controller 180 determines the angular change between the user device and the light source in step 815. Assuming the case where the user device is placed so that the display unit 130 of the user device is facing upward, the angle (the rotation angle of the user device) generated by the rotation (e.g., 90°, 180°, 270°) of the user device and the tilt angle is indicated. That is, most illumination sensors 171 are inserted into the inside of the user device, and the size of light transmitted to the illumination sensor 171 is changed according to the angle between the light source and the user device. Likewise, the rotation of the user device according to the carrying of the user device and the illumination change by the tilt angle may frequently occur. Hence, when the screen brightness is adjusted whenever the illumination is changed according to the rotation of the user device and the tilt, the user's screen concentration decreases, which compromises usability. As such, in an embodiment of the present invention, the noise-type illumination change is recognized for the above phenomenon, and the screen brightness control is exceptionally processed.

According to an embodiment of the present invention, when the illumination sensor 171 is covered (i.e., an illumination-decreasing change (a dark illumination environment)) according to the user's user device gripping state in the user's device's rotated state (e.g., 90°, 180°, 270°), it is determined that the change is a noise-type illumination change, and the current screen brightness is maintained. If the covering of the illumination sensor 171 is canceled in the above state (i.e., the illumination-increasing change (bright illumination environment)), the change is not a noise-type illumination change, and thus the screen brightness is adjusted to be bright.

According to an embodiment of the present invention, if the illumination sensor 171 is covered (i.e., an illumination-decreasing change) in a tilted state for allowing user to observe the display unit 130, it is determined that the change is a noise-type illumination change and the current screen brightness is maintained. When the covering of the illumination sensor 171 is cancelled (i.e., an illumination-increasing change) in the above state, the change is not a noise-type illumination change, and thus the screen brightness is adjusted to be bright.

According to an embodiment of the present invention, if the illumination sensor 171 is covered in a tilt at which a user views the display unit 130 when the illumination sensor 171 is located at the upper part of the display unit 130 (i.e., the illumination-decreasing change (dark illumination environment)), it is determined that the change is a noise-type illumination change and the current screen brightness is maintained. If the covering of the illumination sensor 171 is canceled in the above state (i.e., the illumination-increasing change (bright illumination environment), the change is not a noise-type illumination change, and thus the screen brightness is adjusted to be bright.

Referring to FIG. 8, the controller 180 determines whether the illumination change is a noise-type illumination change according to the angular change in step 809. The current screen brightness value id maintained if it is determined that the change is a noise-type illumination change in step 811. The controller 180 maintains the basic screen brightness value even if the illumination is changed (e.g., illumination decrease) according to the angular change between the light sources that occur by the rotation. of the user device. That is, the controller 180 performs an exceptional process for screen brightness control for the above phenomenon, and processes the screen brightness control routine according to the above-considered illumination change in step 813. An example is displayed in FIG. 9.

As illustrated in FIG. 9, as the size of light transmitted to the illumination sensor 171 is changed, even if the illumination decreases, the existing screen brightness K is maintained. Thereafter, when the illumination measured by the illumination sensor 171 decreases, the controller 180 maintains the same brightness value K as the existing screen brightness K, determines the optimal screen brightness value J corresponding to the optimal brightness profile at the illumination C where the screen brightness value becomes greater than the maximum brightness profile, and sets the screen brightness by the determined optimal screen brightness value J. As the size of light is changed, if the illumination increases, the optimal screen brightness value L is determined according to the above procedure, and the screen brightness by the determined optimal screen brightness value L is set.

As a result of the determination at step 809, if the illumination change is not a noise-type illumination change (No of step 809), the controller 180 proceeds to step 813 so that the screen brightness process is controlled according to the increase of the illumination as considered above.

Figure 10:
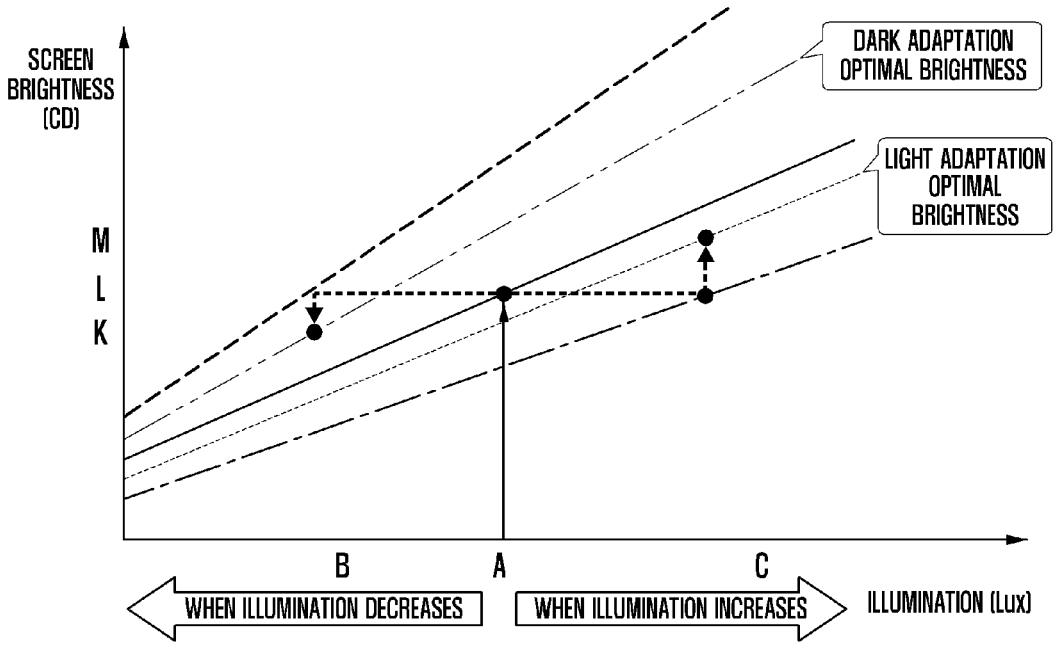
FIG. 10 illustrates an example of a brightness profile by illuminations defined in a user device according to an embodiment of the present invention.

FIG. 10 illustrates an example of a brightness profile by illuminations defined in a user device according to an embodiment of the present invention.

Referring to FIG. 10, two brightness profiles for respective illuminations are additionally provided in addition to the bright profiles for respectively illuminations according to the minimum brightness, the optimal brightness, and the maximum brightness in order to define the screen brightness range according to the illumination as illustrated in FIG. 10.

As illustrated in FIG. 10, the horizontal axis denotes illumination, and the vertical axis denotes screen brightness. Two brightness profiles for respective illuminations of the light adaptation optimal brightness and the dark adaptation optimal brightness are additionally defined to define the screen brightness range according to illumination. The dark adaptation optimal brightness indicates the optimal brightness having the best visibility to user in the dark adaptation situation. The light adaptation optimal brightness indicates the optimal screen brightness having the best visibility to user in the light adaptation.

That is, the speed at which the vision of angle when moved from the dark place to the bright place is adapted to the illumination (light adaptation) is different from the speed at which the vision of angle when moved from the bright place to the dark place is adapted to the illumination (dark adaptation). Adaptation is generally less than or equal to 1 second in the case of bright adaptation, but takes up to thirty (30) minutes in the case of dark adaptation. In the present invention, the time point when the screen brightness is changed according to the user's vision angle characteristics (i.e., light adaptation and dark adaptation), and the screen brightness change level, are adjusted.

When the illumination is changed (e.g., illumination increase or illumination decrease) when the screen is turned on based on the brightness profiles for respective illuminations defined as in FIG. 10, the optimal screen brightness is controlled in consideration of the user's vision characteristics (light adaptation, dark adaptation).

Figure 11:
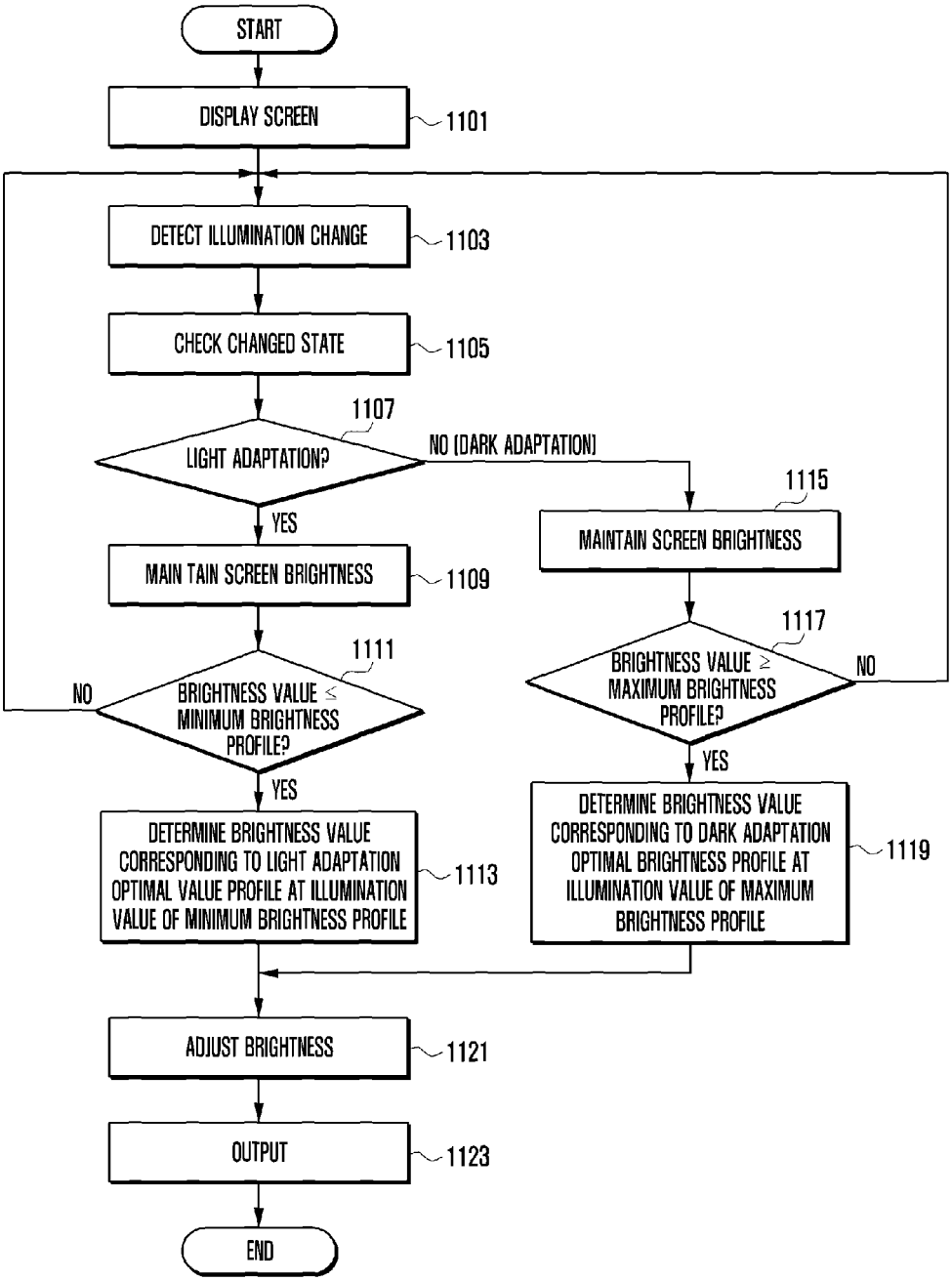
FIGS. 11 to 14 illustrate an operation of controlling screen brightness in consideration of characteristics of a user's angle of vision in a user device according to an embodiment of the present invention.

FIGS. 11 to 14 illustrate an operation of controlling screen brightness in a user device according to an embodiment of the present invention, in consideration of characteristics of a user's angle of vision in a user device when an illumination change (e.g., illumination increase, illumination decrease) occurs while displaying the screen by a certain screen brightness value according to an embodiment of the present invention. The screen brightness control that considers characteristics of a user's vision angle is selectively performed according to a user's option setting. That is, the screen brightness control that considers the characteristics of user's vision angle as displayed in FIG. 11 is or is not operated depending on the user's option setting.

For example, user may selectively check the option that reflects the characteristics on the vision angle (e.g., uses the check box for determining whether to activate the function that reflects the characteristics of the vision angle in the option setting menu) through the option—setting menu (user interface) related to the screen brightness control according to the illumination change. Hence, the controller 180 controls the screen brightness by the reflection of the characteristics of the vision angle according to whether the option of reflecting the characteristics is selected. In the present invention, through the option, the slow change of the screen brightness is reflected when the illumination environment becomes dark, and the fast change of the screen brightness is reflected when the illumination environment becomes bright.

Referring to FIG. 11, the controller 180 detects the illumination value change in step 1103 by the illumination measurement value received from the illumination sensor while displaying the screen in step 1101, by the optimal screen brightness value for the current illumination in the display unit 130. For example, the illumination sensor 171 measures the illumination periodically or according to control of the controller 180, and transmits the measured value to the controller 180, which monitors the illumination measurement value received from the illumination sensor 171, and determines the change of the previous value and the current value. The controller 180 performs detection of an illumination environment change according to the predefined change sensing sensitivity (e.g., sensitively, normally, and slowly).

When detecting the illumination value change, the controller 180 determines the illumination change state in step 1105 and determines whether the illumination change corresponds to the light adaptation or dark adaptation in step 1107. That is, the controller 180 determines whether the illumination change state corresponds to the light adaptation where the illumination value increases when moved from a dark place to a light place, or a dark adaptation where the illumination value decreases when moved from a light place to a dark place.

If it is determined that the illumination change state corresponds to the light adaptation (Yes of step 1107), the controller 180 maintains the current screen brightness value in step 1109 and determines the time point when the screen brightness value becomes less than or equal to the minimum brightness profile in step 1111.

If the screen brightness value does not become less than or equal to the minimum brightness profile (No of step 1111), the controller 180 continually monitors the illumination value change while maintaining the current screen brightness value. The frequent screen brightness change according the illumination change is restricted according to an embodiment of the present invention, and thus user convenience is enhanced.

If the screen brightness value becomes less than or equal to the minimum brightness profile (Yes of step 1111), the controller 180 determines the screen brightness value corresponding to the light adaptation optimal brightness profile on the basis of the illumination value when the screen brightness value becomes less than or equal to the minimum brightness profile in step 1113. That is, the controller 180 refers to the predefined brightness profiles for respective illuminations, extracts the screen brightness value mapped with the light adaptation optimal brightness profile from the illumination value when the screen brightness value becomes less than or equal to the minimum brightness profile, and determines the extracted screen brightness value as the optimal screen brightness value for the illumination value in the light adaptation state.

If it is determined that the illumination change state corresponds to dark adaptation (No of step 1107), the controller 180 maintains the current brightness value in step 1115 and determines the time point when the screen brightness value becomes greater than or equal to the maximum brightness profile in step 1117.

If the screen brightness value does not become greater than or equal to the maximum brightness profile (No of step 1117), the controller 180 maintains the current screen brightness value and continually monitors the illumination value change. As such, frequent screen brightness changes according to the illumination change are restricted, and thus user convenience is enhanced.

If the screen brightness value becomes greater than or equal to the maximum brightness profile (Yes of step 1117), the controller 180 determines the screen brightness value corresponding to the dark adaptation optimal brightness profile on the basis of the illumination value when the screen brightness value becomes greater than or equal to the maximum brightness profile in step 1119. That is, the controller 180 refers to the predefined brightness profiles for respective illuminations, extracts the screen brightness value mapped with the dark adaptation optimal brightness profile from the illumination value when the screen brightness value becomes greater than or equal to maximum brightness profile, and determines the extracted screen brightness value as the optimal screen brightness value for the illumination value at the dark adaptation state.

In step 1121, the controller 180 adjusts the screen brightness by the optimal screen brightness value determined in step 1113 or 1119, and controls the screen output according to the adjusted screen brightness in step 1123. That is, the controller 180 sets the screen brightness of the display unit 130 as the optimal screen brightness corresponding to the current illumination.

Figure 12:
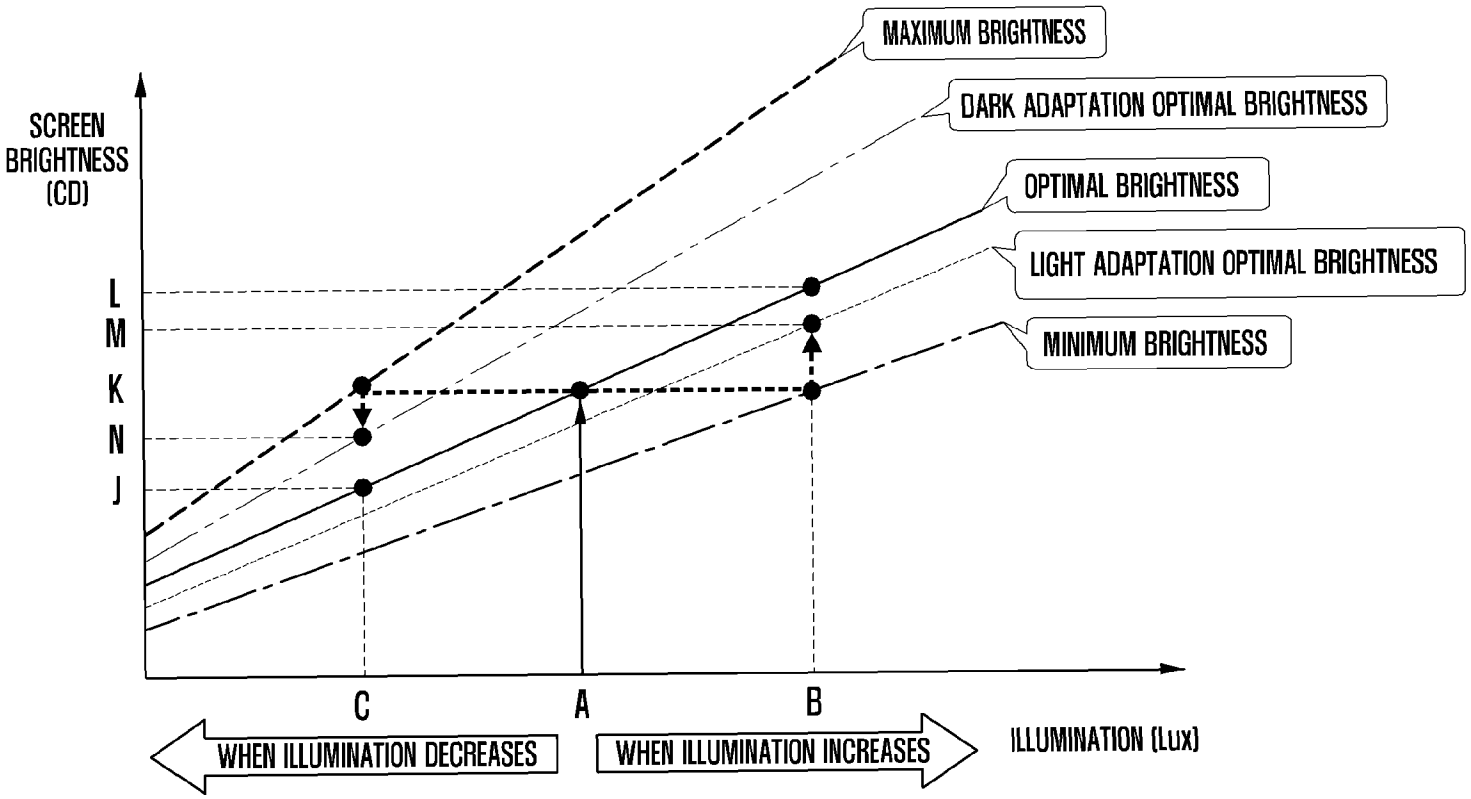
Figure 13:
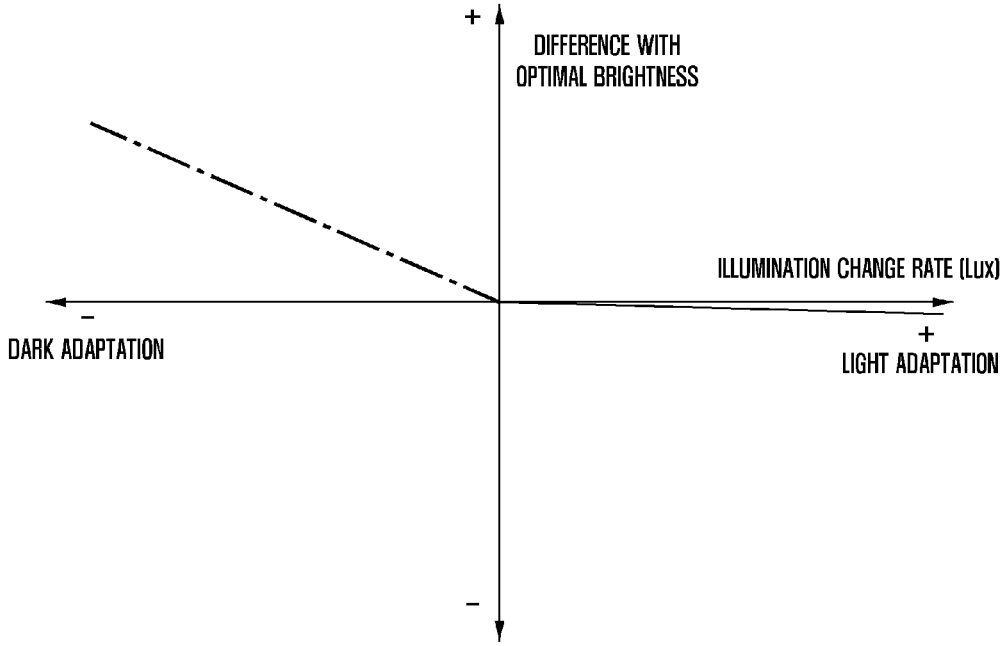
Figure 14:
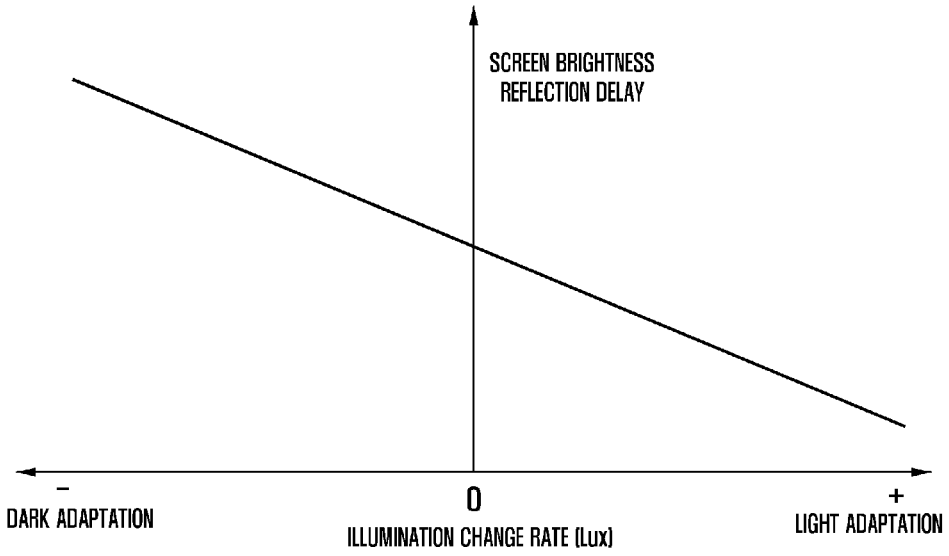

Likewise, the example of determining the screen brightness when the illumination state is changed according to bright adaptation and dark adaptation is illustrated in FIGS. 12 to 14. In particular, FIG. 12 illustrates an example of determining the screen brightness when the illumination increases according to light adaptation and the screen brightness when the illumination decreases according to the dark adaptation. FIG. 13 illustrates a relation between adaptation brightness and the optimal brightness value for the illumination change rate, and FIG. 14 illustrates the relation with the screen reflection delay for the illumination change rate.

As illustrated in FIGS. 12 to 14, it is assumed in FIG. 12 that the current illumination value is A, and the optimal screen brightness value mapped with the illumination A is K. It is further assumed that the illumination value at which the optimal screen brightness value K becomes less than or equal to the minimum brightness profile is B, the screen brightness value of the light adaptation brightness profile mapped with the illumination B is M, and the screen brightness value of the optimal brightness profile mapped with the illumination B is L.

Referring to FIG. 12, when illumination increases according to light adaptation, the controller 180 maintains the same brightness value K, and applies the screen brightness value M corresponding to the light adaptation optimal brightness profile to the screen brightness of the display unit 130 at the illumination B at which the brightness value becomes less than or equal to the minimum brightness profile. That is, the controller 180 searches for the light adaptation optimal brightness corresponding to the illumination when the screen brightness value K becomes less than or equal to the minimum brightness profile (illumination of the minimum brightness) from the mapping table. The controller 180 extracts the mapped light adaptation optimal screen brightness in the illumination of the minimum brightness, and applies the extracted light adaptation optimal screen brightness value M to the screen brightness of the display unit 130.

The controller 180 changes the screen brightness by the light adaptation optimal screen brightness value M and apply the screen brightness value L corresponding to the optimal brightness profile to the screen brightness of the display unit 130 at the illumination B. That is, the controller 180 changes the screen brightness to the light adaptation optimal screen brightness value M, and then additionally changes the brightness to the optimal brightness at the illumination B on the basis of the optimal brightness profile at certain time points (e.g., 1 second, 3 seconds, 5 seconds) according to user definition. Likewise, the screen brightness is changed to the optimal brightness M and then the brightness is additionally changed to the optimal brightness L at the light adaptation. Hence, according to an embodiment of the present invention, sequential optimal brightness changes are provided, and thus user's eye fatigue is reduced and the visibility is enhanced.

The dark adaptation (illumination decrease) will now be described. As illustrated in FIGS. 12 to 14, it is assumed that the current illumination value is A, and the optimal screen brightness value mapped with the illumination A is K. Further, it is assumed that the illumination value at which the optimal screen brightness value K becomes greater than or equal to the maximum brightness profile is C, the screen brightness value of the dark adaptation optimal brightness profile mapped with the illumination C is N, and the screen brightness value of the optimal brightness mapped with the illumination C is J.

Referring to FIG. 12, when the illumination decreases according to the dark adaptation, the controller 180 maintains the same brightness value K, and applies the screen brightness value N corresponding to the dark adaptation optimal brightness profile to the screen brightness of the display unit 130 at the illumination C where the brightness value becomes greater than or equal to the maximum brightness profile. That is, the controller 180 searches for the dark adaptation optimal brightness corresponding to the illumination (illumination at the maximum brightness) when the screen brightness value K becomes greater than or equal to the maximum brightness profile from the mapping table. The controller 180 extracts the dark adaptation optimal screen brightness mapped in the illumination of the maximum brightness, and applies the extracted light adaptation optimal screen brightness value N to the screen brightness of the display unit 130.

The controller 180 changes the screen brightness by the dark adaptation optimal screen brightness N, and then applies the screen brightness value J corresponding to the optimal brightness profile N to the screen brightness of the display unit 130. That is, the controller 180 changes the screen brightness to the dark adaptation optimal screen brightness value N, and then additionally changes the screen brightness to the optimal brightness at the illumination C based on the optimal brightness profile at certain time points (e.g., 1 second, 3 seconds, 5 seconds) according to user definition. Likewise, in an embodiment of the present invention, the screen brightness is changed to the dark adaptation optimal brightness N at dark adaptation, and then the screen brightness is additionally changed to the optimal brightness J. Accordingly, sequential optimal brightness changes are provided, and thus user's eye fatigue is reduced and visibility is enhanced.

Further, as illustrated in FIG. 12, the screen brightness for each illumination according to the optimal brightness profile is different from the screen brightness for each illumination according to an adaptation (light adaptation, dark adaptation) optimal brightness profile. That is, the screen brightness according to light adaptation optimal brightness profile is less than the screen brightness according to the optimal brightness profile at the same illumination (e.g., at illumination B, L>M). The screen brightness according to dark adaptation brightness profile is greater than the screen brightness according to the optimal brightness profile at the same illumination (e.g., at illumination C, N>J). That is, according to an embodiment of the present invention, more appropriate optimal screen brightness according to the illumination change is provided in consideration of the characteristics of the vision angle, such as light adaptation and dark adaptation.

In addition, in the light adaptation, the illumination value measured by the illumination sensor 171 is quickly reflected in the screen compared to that of the dark adaptation. In the dark adaptation, the illumination value measured by the illumination sensor 171 is reflected late compared to the light adaptation, and thus sufficient dark adaptation time is secured.

As illustrated in FIGS. 12 to 14, the brightness difference between the screen brightness value L of the optimal brightness profile and the screen brightness value M of the light adaptation optimal brightness profile is greater than the brightness difference between the screen brightness value J of the optimal brightness profile and the screen brightness value N of the dark adaptation optimal brightness profile. This indicates that the screen brightness reflection delay increases when changed from a light illumination environment to a dark illumination environment, and decreases when changed from a dark illumination environment to a light illumination environment. That is, the brightness change time is variable according to the illumination change rate in consideration of characteristics of vision angle, as illustrated in FIG. 14.

Referring to FIGS. 12 and 14, the screen brightness value N of the dark adaptation optimal brightness profile and the screen brightness value J of the optimal brightness profile correspond to the dark adaptation state of the left area of FIG. 14. That is, the screen brightness is changed through two steps, which is time-consuming. In contrast, the screen brightness value M of the light adaptation optimal brightness profile and the screen brightness value L of the optimal brightness profile correspond to the light adaptation state of the right area of FIG. 14. That is, the screen brightness change occurs trough two steps, but there is no significant difference between the optimal brightness L and the light adaptation optimal brightness M, and thus the screen brightness change time decreases.

Figure 15:
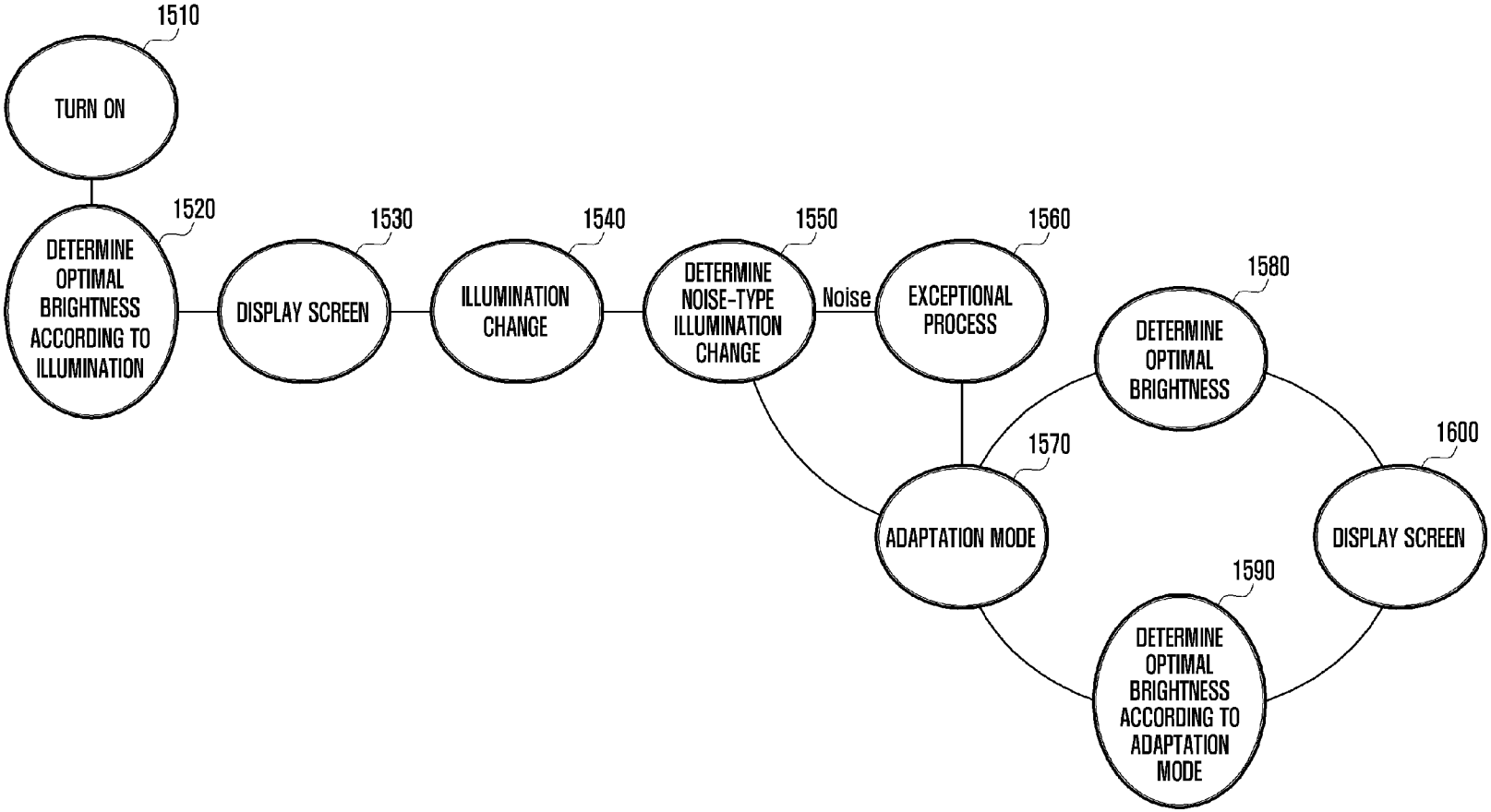
FIG. 15 illustrates an operation of controlling screen brightness according to illumination in a user device according to an embodiment of the present invention.

FIG. 15 illustrates an operation of controlling screen brightness in a user device according to an embodiment of the present invention.

In particular, FIG. 15 illustrates an example of an operation when controlling screen brightness of the present invention is performed by one scenario.

Referring to FIG. 15, the controller 180 determines the optimal brightness according to the illumination the instance when the display unit 130 is turned on in step 1510 with reference to the brightness profile for each illumination in step 1520. The controller 180 controls the screen display according to the determined optimal brightness in step 1530.

If the illumination change is detected during the screen display in step 1540, the controller 180 determines whether the illumination change corresponds to the noise-type illumination change in step 1550. The controller 180 detects the illumination environment change according to the predefined change sensing sensitivity (e.g., sensitive, normal, and slow). If the illumination change corresponds to the noise-type illumination change, the controller 180 applies an exceptional process for the noise-type illumination change in step 1560.

The controller 180 determines whether the change corresponds to the noise-type illumination change or whether adaptation mode has been set in consideration of characteristics of the user's vision angle after an exceptional process for the noise-type illumination change in step 1570.

The controller 180 determines the optimal brightness with reference to the brightness profiles for each illumination according to whether the adaptation mode has been set up or in consideration of characteristics of the vision angle in steps 1580 and 1590. That is, when the adaptation mode is not set, the controller 180 determines the optimal brightness according to the illumination change based on the optimal brightness profile of the brightness profile for each illumination. When the adaptation mode is set, the controller 180 determines the adaptation optimal brightness in consideration of the characteristics of the vision angle for the illumination change on the basis of the adaptation optimal brightness profile of the brightness profile for each illumination.

For example, when the adaptation mode is not set, the controller determines the optimal brightness for each illumination with reference to the brightness profile for each illumination according to the minimum brightness, the optimal brightness, and the maximum brightness in step 1580. When the adaptation mode is set, the controller 180 determines the optimal brightness for each illumination in consideration of the characteristics of the user's vision angle with reference to the brightness profile for each illumination according to the minimum brightness, dark adaptation optimal brightness, optimal brightness, light adaptation optimal brightness, and the maximum brightness in step 1590.

The controller 180 controls the screen display according to the determined optimal brightness in step 1600.

The foregoing embodiments of the present invention are implemented in an executable program command form by various computer means and may be recorded in a computer readable recording medium including a program command, a data file, and a data structure individually or a combination thereof. The program command recorded in a recording medium is specially designed or configured for the present invention or is known to a person having ordinary skill in a computer software field to be used.

The computer readable recording medium includes Magnetic Media such as hard disk, floppy disk, or magnetic tape, Optical Media such as Compact Disc Read Only Memory (CD-ROM) or Digital Versatile Disc (DVD), Magneto-Optical Media such as floptical disk, and a hardware device such as ROM. RAM, flash memory storing and executing program commands. The program command includes a machine language code created by a complier and a high-level language code executable by a computer using an interpreter. The foregoing hardware device is configured to be operable as at least one software module to perform an operation of the present invention, and vice versa.

According to a method and apparatus for controlling screen brightness according to an illumination change of the present invention, an automatic screen brightness control algorithm according to illumination is improved, and a screen brightness which is more appropriate to a user are provided. In particular, according to the present invention, readability of user device is improved by additionally considering characteristics of the angle of vision and a noise-type illumination change. As such, a function of controlling screen brightness capable of satisfying needs for a plurality of users is provided.

According to the present invention, user's screen concentration is enhanced while reducing user's eyes' fatigue according to frequent screen brightness changes by providing screen brightness in consideration of an environment where illumination is changed at the time of controlling screen brightness according to illumination. Further, according to the present invention, a brightness control error by user's intentional covering of the illumination sensor is reduced through distinguishing a noise-type illumination change and control of screen brightness according thereto. Further, according to the present invention, when controlling the screen brightness according to an illumination change, the screen brightness is controlled in consideration of characteristics of the angle of vision such as light adaptation and dark adaptation, and thus the user's eyes' fatigue is reduced and visibility is enhanced.

Hence, according to the present invention, user convenience is improved, and usability, convenience and competitiveness of user device are improved by implementing an optimal environment for supporting automatic control of screen brightness according to an illumination change. The present invention is simply implemented to all forms of user devices having a display unit and various devices corresponding thereto.

Although embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A method of controlling a screen brightness in a user device, the method comprising:

detecting a first illumination when a display unit is turned on;

determining a first optimal brightness corresponding to the first illumination with reference to a first profile of a plurality of predefined brightness profiles for respective illuminations, and controlling the screen brightness to be the first optimal brightness;

maintaining, in response to an illumination change being detected, the screen brightness as the first optimal brightness;

detecting, a second illumination corresponding to the first optimal brightness with reference to a second profile of the plurality of predefined brightness profiles; and determining, in response to the illumination change reaching the second illumination, a second optimal brightness corresponding to the second illumination with reference to the first profile, and controlling the screen brightness to be the second optimal brightness.

2. The method of claim 1, wherein the plurality of predefined brightness profiles for the respective illuminations include a minimum brightness profile, an optimal brightness profile, and a maximum brightness profile, and wherein the first profile is the optimal brightness profile, and the second profile is the minimum brightness profile or the maximum brightness profile.

3. The method of claim 2, wherein detecting the second illumination comprises:

detecting an illumination at which the first optimal brightness becomes less than or equal to the screen brightness corresponding to the minimum brightness profile when the illumination increases, wherein the threshold is the detected illumination, and wherein the screen brightness corresponding to the optimal brightness profile in the detected illumination is determined as the second optimal brightness according to the illumination change.

4. The method of claim 2, wherein detecting the second illumination comprises:

detecting an illumination at which the first optimal brightness becomes greater than or equal to the screen brightness corresponding to the maximum brightness profile when the illumination decreases, wherein the threshold is the detected illumination, and wherein the screen brightness corresponding to the optimal brightness profile at the detected illumination is determined as the second optimal brightness according to the illumination change.

5. The method of claim 2, wherein maintaining the screen brightness as the first optimal brightness comprises:

analyzing whether the illumination change corresponds to a noise-type illumination change when the illumination change is detected.

6. The method of claim 5, wherein the noise-type illumination change includes an illumination change that is generated as an illumination sensor is covered when a user uses the user device, and an illumination change that is generated as an angle between the user device and a light source is changed.

7. The method of claim 5, wherein maintaining the screen brightness as the first optimal brightness comprises:

maintaining the screen brightness as the first optimal brightness if the illumination change corresponds to the noise-type illumination change; and controlling the screen brightness maintained as the first optimal brightness when the changed illumination reaches the threshold of the plurality of predefined brightness profiles.

8. The method of claim 5, further comprises sensing a criterion state of sensing the illumination change according to a change-sensing sensitivity.

9. The method of claim 1, wherein the plurality of predefined brightness profiles for the respective illuminations include a minimum brightness profile, a dark adaptation optimal brightness profile, an optimal brightness profile, a light adaptation optimal brightness profile, and a maximum brightness profile.

10. The method of claim 9, wherein detecting the second illumination comprises:

detecting an illumination at which the first optimal brightness becomes less than or equal to the screen brightness corresponding to the minimum brightness profile when the illumination increases, wherein the threshold is the detected illumination, and wherein the screen brightness corresponding to the light adaptation optimal brightness profile at the detected illumination is determined as the second optimal brightness according to the illumination change.

11. The method of claim 9, wherein detecting the second illumination comprises:

detecting an illumination at which the first optimal brightness becomes greater than or equal to the screen brightness corresponding to the maximum brightness profile when the illumination decreases, wherein the threshold is the detected illumination, and wherein the screen brightness corresponding to the dark adaptation optimal brightness profile at the detected illumination is determined as the second optimal brightness according to the illumination change.

12. The method of claim 9, wherein the screen brightness of the light adaptation optimal brightness profile is less than the screen brightness of the optimal brightness profile at a same illumination, and the screen brightness of the dark adaptation optimal brightness profile is greater than the screen brightness of the optimal brightness profile at a same illumination.

13. The method of claim 9, wherein the changed illumination measured by an illumination sensor in a light adaptation is reflected in the screen brightness in a shorter time than in a dark adaptation, and the changed illumination measured by the illumination sensor in the dark adaptation is reflected in the screen brightness in a longer time than in the light adaptation, so as to secure a sufficient dark adaptation time.

14. A method of controlling a screen brightness in a user device, the method comprising:

detecting an illumination when a screen is turned on, and determining a first optimal brightness corresponding to the illumination with reference to an optimal brightness profile of a plurality of brightness profiles for respective illuminations;

controlling the screen brightness to be the determined first optimal brightness;

detecting an illumination change during the screen brightness is controlled to be the determined first optimal brightness;

determining whether the illumination change corresponds to a noise-type illumination change;

performing an exceptional process for the noise-type illumination change if the illumination change corresponds to the noise-type illumination change;

determining whether an adaptation mode that considers characteristics of a user's vision angle is set after performing the exceptional process for the noise-type illumination change, or when the illumination change does not correspond to the noise-type illumination change;

detecting a second illumination corresponding to the determined first optimal brightness with reference to a minimum or maximum profile of the plurality of predefined brightness profiles, and determining a second optimal brightness corresponding to the illumination change based on the optimal brightness profile of the plurality of brightness profiles when the illumination change reaches the second illumination, if the adaptation mode has not been set;

detecting the second illumination corresponding to the determined first optimal brightness with reference to the minimum or maximum profile of the plurality of predefined brightness profiles, and determining an adaptation optimal brightness corresponding to the illumination change based on an adaptation optimal brightness profile of the plurality of brightness profiles when the illumination change reaches the third illumination, if the adaptation mode has been set; and controlling the screen brightness to be the determined second optimal brightness or the determined adaptation optimal brightness.

15. The method of claim 14, wherein the second optimal brightness is determined with reference to the plurality of brightness profiles including a minimum brightness profile, the optimal brightness profile, and a maximum brightness profile when the adaptation mode has not been set, and wherein the adaptation optimal brightness is determined with reference to the plurality of brightness profiles including a minimum brightness profile, a dark adaptation optimal brightness profile, the optimal brightness profile, a light adaptation optimal brightness profile, and a maximum brightness profile when the adaptation mode has been set.

16. The method of claim 14, further comprises sensing a criterion state of sensing the illumination change according to a change-sensing sensitivity.

17. A user device, comprising:

an illumination sensor configured to measure an illumination surrounding the user device;

a display unit configured to display a screen corresponding to a screen brightness determined according to the surrounding illumination;

a storage unit configured to store a plurality of brightness profiles for respective illuminations; and a controller configured to:

control the screen brightness by determining a first optimal brightness according to a first illumination when the display unit is turned on with reference to a first profile of the plurality of brightness profiles;

maintain, in response to an illumination change being detected, the screen brightness as the first optimal brightness, and detect a second illumination corresponding to the first optimal brightness with reference to a second profile of the plurality of brightness profiles;

determine a second optimal brightness corresponding to the second illumination with reference to a third profile of the plurality of brightness profiles in response to the illumination change reaching the second illumination; and control the screen brightness to be the second optimal brightness.

18. The user device of claim 17, wherein the plurality of brightness profiles for the respective illuminations include a minimum brightness profile, a dark adaptation optimal brightness profile, an optimal brightness profile, a light adaptation optimal brightness profile, and a maximum brightness profile, and wherein the first profile is the optimal brightness profile, the second profile is the minimum brightness profile or the maximum brightness profile, and the third profile is the dark adaptation optimal brightness profile or the light adaptation optimal brightness profile.

19. The user device of claim 17, wherein the controller is further configured to:

analyze whether the illumination change is a noise-type illumination change when the illumination change is detected, and maintain the first optimal brightness if the illumination change is a noise-type illumination change; and determine the second optimal brightness corresponding to the second illumination when the changed illumination reaches the threshold of the plurality of brightness profiles for respective illuminations while maintaining the screen brightness as the first optimal brightness.

20. The user device of claim 19, wherein the controller is further configured to sense the noise-type illumination change according to a change-sensing sensitivity, which defines a criterion state of sensing the illumination change.

21. The user device of claim 17, wherein the controller is further configured to determine the second optimal brightness according to the illumination change based on an optimal brightness profile of the plurality of brightness profiles in an adaptation mode non-setting state, and determine the second optimal brightness according to the illumination change based on an adaptation optimal brightness profile of the plurality of brightness profiles in an adaptation mode setting state.

22. The user device of claim 21, wherein in a light adaptation, the controller is further configured to reflect the changed illumination measured by the illumination sensor in the screen brightness in a shorter time compared to a dark adaptation, and in the dark adaptation, the controller is further configured to reflect the changed illumination measured by the illumination sensor in the screen brightness in a longer time compared to the light adaptation, so as to secure a sufficient dark adaptation time.

23. A non-transitory computer-readable recording medium having recorded thereon a method of controlling a screen brightness in a user device, the method comprising:

detecting a first illumination when a display unit is turned on;

determining a first optimal brightness corresponding to the first illumination with reference to a first profile of a plurality of predefined brightness profiles for respective illuminations, and controlling the screen brightness to be the first optimal brightness;

maintaining, in response to an illumination change being detected, the screen brightness as the first optimal brightness;

detecting a second illumination corresponding to the first optimal brightness with reference to a second profile of the plurality of predefined brightness profiles; and determining, in response to the illumination change reaching the second illumination, a second optimal brightness corresponding to the second illumination with reference to the first profile, and controlling the screen brightness to be the second optimal brightness.

* * * * *